United States Patent [19]

Ishikawa

[11] Patent Number: 4,954,426

[45] Date of Patent: Sep. 4, 1990

[54] METHODS FOR PROCESSING SILVER HALIDE COLOR PHOTOGRAPHIC LIGHT-SENSITIVE MATERIALS

[75] Inventor: Takatoshi Ishikawa, Minami-ashigara, Japan

[73] Assignee: Fuji Photo Film Co., Ltd., Minami-ashigara, Japan

[21] Appl. No.: 187,600

[22] Filed: Apr. 28, 1988

[30] Foreign Application Priority Data

Apr. 30, 1987 [JP] Japan ..... 62-106600

[51] Int. Cl.[5] ..... G03C 7/16; G03C 7/42

[52] U.S. Cl. ..... 430/386; 430/376; 430/393; 430/400; 430/460

[58] Field of Search ..... 430/393, 400, 372, 375, 430/386, 387, 428, 430, 421, 463, 376, 460

[56] References Cited

U.S. PATENT DOCUMENTS

| | | | |
|---|---|---|---|
| 3,615,508 | 10/1971 | Stephen et al. | 430/461 |
| 4,264,723 | 4/1981 | Ichijima et al. | 430/387 |
| 4,314,753 | 2/1982 | Kaufmann | 354/321 |
| 4,351,897 | 9/1982 | Aoki et al. | 430/555 |
| 4,621,046 | 11/1986 | Sato et al. | 430/381 |
| 4,752,556 | 6/1988 | Kishimoto | 430/398 |
| 4,756,918 | 7/1988 | Ueda et al. | 430/430 |
| 4,789,626 | 12/1988 | Sakanoue et al. | 430/393 |
| 4,798,784 | 1/1989 | Kishimoto et al. | 430/400 |

FOREIGN PATENT DOCUMENTS

| | | |
|---|---|---|
| 0132806 | 7/1984 | European Pat. Off. . |
| 0196091 | 3/1986 | European Pat. Off. . |
| 2165954 | 4/1986 | United Kingdom . |

*Primary Examiner*—Paul R. Michl
*Assistant Examiner*—Hoa Van Le
*Attorney, Agent, or Firm*—Burns, Doane, Swecker & Mathis

[57] ABSTRACT

A method for processing a silver halide color photographic light-sensitive material comprises color developing the light-sensitive material and then subjecting it to bleach-fixing treatment, the amount of bleach-fixing solution replenished being 0.2 to 15 times the volume of the color developer carried over, to the bleach-fixing bath, by the processed light-sensitive material per unit area thereof and not less than 80 mole % of the total non-metallic cations present in the replenisher for the bleach-fixing solution being ammonium ions. This method makes it possible to substantially reduce the magenta stains formed after processing due to the magenta couplers used.

15 Claims, No Drawings

METHOD FOR PROCESSING SILVER HALIDE COLOR PHOTOGRAPHIC LIGHT-SENSITIVE MATERIALS

BACKGROUND OF THE INVENTION (1) Field of the Invention

The present invention relates to a method for processing silver halide color photographic light-sensitive material and more particularly to a method for processing such material, which makes it possible to prevent the processed light-sensitive material from causing magenta stains over the lapse of time.

(2) Prior Art

In the processing of silver halide color photographic light-sensitive materials, it is important to simplify, speed up and stabilize the processing while insuring adequate environmental protection. Accordingly, various studies regarding this subject have been conducted.

Particularly, for the purposes of saving the natural resources, lowering the cost and ensuring the environmental protection, methods for reducing the amount of replenishers for these processes are highly practical and, for this reason, many attempts have been directed to the development of such methods. However, there have been various problems encountered during the attempts to reduce the amount of each replenisher. Particularly, attempts to reduce the amounts of the bleach-fixing solution has resulted in an increase in the amount of color developer which is carried over by the processed light-sensitive material from the bath preceding the bleach-fixing bath. This, in turn, leads to the increase in magenta stains of the processed light-sensitive material over the lapse of time after processing.

In order to solve this problem, there has been proposed that a magenta coupler having high light fastness is used. Examples of such magenta couplers include those disclosed in Japanese Patent Un-examined Publication (hereunder referred to as "J.P. KOKAI") Nos. 59-162548, 60-43659, 59-171956, 60-172982 and 60-33552 and U.S. Pat. No. 3,061,432; and couplers disclosed in Japanese Patent Publication for Opposition Purpose (hereinafter referred to as "J.P. KOKOKU") No. 53-34044, J.P. KOKAI Nos. 55-62454 and 57-35858. However, the foregoing problem cannot be solved even if such a magenta coupler is used.

Under such circumstances, it has been proposed to adopt conventional discoloration inhibiting techniques or stain inhibiting techniques in the processing of the light-sensitive materials and as a result various techniques have been reported. Specific examples of the discoloration inhibiting techniques are disclosed in U.S. Pat. Nos. 2,360,290; 2,418,613; 2,675,314 and 2,701,197; U.K. Pat. No. 1,363,921 and J.P. KOKAI No. 58-24141 in which hydroquinone derivatives are used; U.S. Pat. Nos. 3,457,079 and 3,069,262 in which gallic acid derivatives are employed; U.S. Pat. No. 2,735,765 and J.P. KOKOKU No. 49-20977 in which p-alkoxyphenols are used; U.S. Pat. Nos. 3,432,300 and 3,573,050 and J.P. KOKAI Nos. 52-35633 and 52-147434 in which p-oxyphenol derivatives are used; and U.S. Pat. No. 3,700,455 which discloses the use of bisphenols. Specific examples of the stain inhibiting techniques are disclosed in J.P. KOKAI Nos. 50-57223 and 56-85747 and However, these techniques do not show sufficient effects.

On the other hand, U.S. Pat. No. 3,615,508 and J.P. KOKAI No. 50-140128 propose the use of ammonium ions as cations in the bleach-fixing solution to enhance the desilvering properties thereof. J.P. KOKAI No. 55-144241 also discloses that the bleach-fixing solution can be concentrated by using ammonium ion as a cation. However, these patents disclose neither the reduction of the replenisher for the bleach-fixing solution nor the stains due to magenta couplers used.

SUMMARY OF THE INVENTION

Accordingly, a principal purpose of the present invention is to provide a method for processing silver halide color photographic light-sensitive materials, in which stains of the processed materials due to magenta couplers can be avoided even when the amount of replenisher for the bleach-fixing solution is reduced.

The inventors of the present invention have conducted various studies to eliminate the foregoing problems associated with the conventional method for processing silver halide color photographic light-sensitive materials and have found that these problems can conveniently be solved by utilizing a replenisher containing a desired amount of ammonium ions as cations and thus completed the present invention based on such a finding.

The aforementioned and other purposes of the present invention can effectively be accomplished by providing a method for processing silver halide color photographic light-sensitive materials which comprises color developing the light-sensitive material and then subjecting it to bleach-fixing treatment, the amount of a replenisher for the bleach-fixing solution being limited to 0.2 to 15 times the volume of the color developer carried out from the preceding bath to the bleach-fixing bath per unit area of the processed light-sensitive material and at least 80 mole% of the total non-metallic cations in the replenisher for the bleach-fixing bath being ammonium ions.

DETAILED EXPLANATION OF THE INVENTION

In the present invention, the silver halide color photographic light-sensitive materials (hereunder referred to as "light-sensitive material(s)" for simplicity) are first color developed and then treated by a specific bleach-fixing process. The light-sensitive material is treated by, for instance, the following processes:

(i) Color development—bleach-fixing—water washing—drying;

(ii) Color development—bleach-fixing—stabilization—drying;

(iii) Color development—bleach-fixing—water washing—stabilization—drying.

In the foregoing processes (i) to (iii), it is also possible to carry out a fixing process after the bleach-fixing process or simple rinsing processes between the color development and the bleach-fixing processes.

Each process will be explained in more detail below.

(Color Development)

The color developer used in the present invention contains known aromatic primary amine color developing agents. Preferred examples thereof are p-phenylenediamine derivatives of which typical examples are as follows, however, the invention is not restricted to these specific examples:

D-1: N,N-Diethyl-p-phenylenediamine;

D-2: 2-Amino-5-diethylaminotoluene;

D-3: 2-Amino-5-(N-ethyl-N-laurylamino)-toluene;

D-4: 4-(N-Ethyl-N-(beta-hydroxyethyl)-amino)-aniline;
D-5: 2-Methyl-4-(N-ethyl-N-(beta-hydroxyethyl)-amino)-aniline;
D-6: 4-Amino-3-methyl-N-ethyl-(beta-(methanesulfonamido)-ethyl)-aniline;
D-7: N-(2-Amino-5-diethylaminophenylethyl)-methanesulfonamide;
D-8: N,N-Dimethyl-p-phenylenediamine;
D-9: 4-Amino-3-methyl-N-ethyl-N-methoxyethylaniline;
D-10: 4-Amino-3-methyl-N-ethyl-N-beta-ethoxyethylaniline;
D-11: 4-Amino-3-methyl-N-ethyl-N-beta-butoxyethylaniline.

Among the foregoing p-phenylenediamine derivatives, preferred is 4-amino-3-methyl-N-ethyl-N-(beta-(methanesulfonamido)-ethyl)-aniline (exemplified compound D-6).

These p-phenylenediamine derivatives may be in the form of salts such as sulfates, hydrochlorides, sulfites or p-toluenesulfonates. The amount of the aromatic primary amine developing agent preferably ranges from about 0.1 to about 20 g and mroe preferably about 0.5 to 10 g per liter of the color developer.

The color developer may optionally contain, as a preservative, a sulfite such as sodium sulfite, potassium sulfite, sodium bisulfite, potassium bisulfite, sodium metasulfite and potassium metasulfite; or a carbonyl/-sulfite adduct.

It is also preferable to add a compound capable of directly preserving the color developing agents, such as various hydroxylamines; hydroxamic acid disclosed in J.P. KOKAI No. 63-43138; hydrazines and hydrazides disclosed in EP 254280 (U.S. Ser. No. 76505); phenols disclosed in J.P. KOKAI No. 63-44657 and Japanese Patent Application Serial (hereunder referred to as "J.P.A.") 61-203253; alpha-hydroxyketones and alpha-aminoketones disclosed in J.P. KOKAI No. 63-44656; and/or various sugars disclosed in J.P. KOKAI No. 63-36244. It is preferable to use, in combination with the foregoing compounds, monoamines disclosed in J.P. KOKAI Nos. 63-4235, 63-24254, 63-21647, 63-27841 and U.S. Ser. No. 72479 and 74983; diamines disclosed in J.P. KOKAI Nos. 63-30845, 63-43139 (U.S. Ser. No. 84941) and U.S. Ser. No. 72479; polyamines disclosed in J.P. KOKAI Nos. 63-21647, 63-26655 (U.S. Ser. No. 74430) and 63-44655; nitroxy radicals disclosed in J.P. KOKAI No. 63-53551, alcohols disclosed in J.P. KOKAI Nos. 63-43140 and 63-53349; oximes disclosed in J.P. KOKAI No. 63-56654; and tertiary amines disclosed in U.S. Ser. No. 117727.

Other preservative such as various metals disclosed in J.P. KOKAI Nos. 57-44148 and 57-53749; salicylic acids disclosed in J.P. KOKAI No. 59-180588; alkanol amines disclosed in J.P. KOKAI No. 54-3532; polyethyleneimines disclosed in J.P. KOKAI No. 56-94349; and aromatic polyhydroxyl compounds disclosed in U.S. Pat. No. 3,746,544 is optionally added to the developer. Particularly, preservatives such as aromatic polyhydroxy compounds, alkanol amines and compounds disclosed in J.P.A. No. 61-264159 are preferably added thereto.

The pH value of the color developers used in the invention preferably ranges from 9 to 12, more preferably 9 to 11.0. The color developers may further contain other known components for developer.

Various buffering agents are preferably used to hold the foregoing pH range. Examples thereof are carbonates, phosphates, borates, tetraborates, hydroxybenzoates, glycyl salts, N,N-dimethyl glycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts and lycine salts. It is particularly preferred to use, as such a buffering agent, carbonates, phosphates, tetraborates and hydroxybenoates because they exhibit good solubility, excellent buffering ability at high pH range of not less than 9.0, exert no influence (such as fog) on the photographic properties and are cheap.

Specific examples thereof include sodium carbonate, potassium carbonate, sodium bicarbonate, potassium bicarbonate, trisodium phosphate, tripotassium phosphate, disodium hydrogen phosphate, dipotassium hydrogen phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). However, the invention is not restricted to these specific examples.

The amount of these buffering agents added to the color developers is preferably at least 0.1 mole/l and more preferably 0.1 to 0.4 mole/l.

The color developer further comprises a variety of chelating agents as a suspension stabilizer for calcium and magnesium or a stabilizer for the color developer.

Preferred chelating agents are organic compounds and examples thereof include aminopolycarboxylic acids disclosed in J.P. KOKOKU Nos. 48-30496 and 44-30232; organic phosphonic acids disclosed in J.P. KOKAI No. 56-97347, J.P. KOKOKU No. 56-39359 and German Patent No. 2,227,639: phosphonocarboxylic acids disclosed in J.P. KOKAI Nos. 52-102726, 53-42730, 54-121127, 55-126241 and 55-659506; and other compounds disclosed in J.P. KOKAI Nos. 58-195845 and 58-203440 and J.P. KOKOKU No. 53-40900. Specific examples thereof will be listed below, but the present invention is not restricted to these specific examples:

Nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, transcyclohexanediaminetetraacetic acid, 1,2-diaminopropanetetraacetic acid, glycol ether diaminetetraacetic acid, ethylenediamine-o-hydroxyphenylacetic acid, 2-phosphonobutane-1,2,4-tricarboxylic acid, 1-hydroxyethylidene-1,1-diphosphonic acid, N,N'-bis(2-hydroxybenzyl)-ethylenediamine-N,N'-diacetic acid and hydroxyethyliminodiacetic acid. These chelating agents may optionally be used in combination.

These chelating agents may be used in an amount sufficient to sequester metal ions present in the color developer. For instance, they are used in the order of 0.1 to 10 g/l.

The color developer optionally comprises any development accelerators. However, the color developer used in the invention is preferably substantially free from benzyl alcohol from the viewpoint of environmental protection, easy preparation thereof and prevention of color stains. The term "substantially free from" herein means that the content of benzyl alcohol is not more than 2 ml per liter of the color developer and preferably zero. In this connection, if a color developer which is substantially free from benzyl alcohol is used, an increase of magenta stain with the lapse of time after processing can be effectively prevented.

Examples of development accelerators usable in the invention are thioether type compounds disclosed in J.P. KOKOKU Nos. 37-16088, 37-5987, 38-7826, 44-12380 and 45-9019 and U.S. Pat. No. 3,813,247; p-phenylenediamine type compounds disclosed in J.P. KOKAI Nos. 52-49829 and 50-15554; quaternary ammonium salts disclosed in J.P. KOKAI Nos. 50-137726, 56-156826 and 52-43429 and J.P. KOKOKU No. 44-30074; amine type compounds disclosed in U.S. Ser. Nos. 2,494,903, 3,128,182, 4,230,796, 3,253,919, 2,482,546, 2,596,926 and 3,582,346 and J.P. KOKOKU No. 41-11431; polyalkylene oxides disclosed in J.P. KOKOKU Nos. 37-16088, 42-25201, 41-11431 and 42-23883 and U.S. Pat. Nos. 3,128,183 and 3,532,501; 1-phenyl-3-pyrazolidones; and imidazoles.

The color developers as used herein may contain any antifoggants which may be alkali metal halides such as sodium chloride, potassium bromide and potassium iodide and organic antifoggants. Typical examples of such organic antifoggants include nitrogen-containing heterocyclic compounds such as benzotriazole, 6-nitrobenzimidazole, 5-nitrosoindazole, 5-methylbenzotriazole, 5-nitrobenzotriazole, 5-chlorobenzotriazole, 2-thiazolyl-benzimidazole, 2-thiazolylmethylbenzimidazole, indazole, hydroxyazaindolizine and adenine.

The color developers used in the invention preferably comprise a fluorescent whitener which is preferably 4,4'-diamino-2,2'-disulfostilbene type compounds. The amount thereof ranges from 0 to 5 g/l, preferably 0.1 to 4 g/l.

It may also contain, if necessary, various surfactants such as alkyl sulfonic acids, aryl sulfonic acids, aliphatic carboxylic acids, and aromatic carboxylic acids.

Temperature of the color developer of the invention during processing ranges from 20° to 50° C., preferably 30° to 40° C. while processing time therefor ranges from 20 seconds to 5 minutes, preferably 30 seconds to 2 minutes. The amount of replenisher is preferably as low as possible, however, it is generally 20 to 600 ml, preferably 50 to 300 ml and more preferably 100 to 200 ml per 1 $m^2$ of the processed light-sensitive material.

(Bleach-Fixing)

In the method of this invention, as the residence time of the light-sensitive material in the bleach-fixing process is shortened, the effects of the invention become noticeable. Therefore, the residence time is desirably not more than 4 minutes, more preferably 15 to 120 seconds, most preferably 20 to 70 seconds and the processing time can thereby be reduced as short as possible.

The bleaching agents used in the bleach-fixing solution are not limited to any specific ones, but preferred examples thereof are organic complex salts of the iron(III) such as those with aminopolycarboxylic acids (e.g., ethylenediaminetetraacetic acid diethylenetriaminepentaacetic acid), aminopolyphosphonic acids, phosphonocarboxylic acids and organic phosphonic acids; organic acids such as citric acid, tartaric acid and malic acid; persulfates; hydrogen peroxide.

The organic complex salts of iron(III) are particularly preferred in view of environmental protection and rapid processing. Examples of the aminopolycarboxylic acids, aminopolyphosphonic acids, organic phosphonic acids and salts thereof useful for forming such organic complex salts of iron(III) are ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid and glycol ether diaminetetraacetic acid.

These compounds may be either of sodium, potassium, lithium and ammonium salts. Among these, preferred are ferric salts of ethylenediaminetetraacetic acid, diethylenetriaminepentaacetic acid, cyclohexanediaminetetraacetic acid, 1,3-diaminopropanetetraacetic acid and methyliminodiacetic acid because of their high bleaching ability.

These ferric ion complex salts may be used as they are or these may be formed in situ by reacting, in a solution, a ferric salt such as ferric sulfate, ferric chloride, ferric nitrate, ferric ammonium sulfate or ferric phosphate with a chelating agent such as aminopolycarboxylic acids, aminopolyphosphonic acids or phosphonocarboxylic acids in which the latter may be used in excess amount greater than the stoichiometric amount. Preferred ferric complex are those with aminopolycarboxylic acids and the amount thereof to be added is 0.01 to 1.0 mole/l, preferably 0.05 to 0.50 mole/l.

The bleach-fixing solution may contain various bleaching accelerators. Preferred examples thereof include compounds having mercapto groups or disulfide bonds disclosed in U.S. Pat. No. 3,893,858, German Patent No. 1,290,812, J.P. KOKAI No. 53-95630 and Research Disclosure No. 17129 (July, 1978); thiourea type compounds disclosed in J.P. KOKOKU No. 45-8506, J.P. KOKAI Nos. 52-20832 and 53-32735 and U.S. Pat. No. 3,706,561; or halides such as iodides or bromides in view of their high bleaching ability.

Besides, the bleach-fixing solution may contain rehalogenating agents such bromides as potassium bromide, sodium bromide and ammonium bromide; such chlorides as potassium chloride, sodium chloride and ammonium chloride; or such iodides as ammonium iodide. The bleach-fixing solution may optionally contain at least one inorganic acids, organic acids or their alkali metal or ammonium salts having pH buffering ability such as boric acid, borax, sodium metaborate, acetic acid, sodium acetate, sodium carbonate, potassium carbonate, phosphorous acid, phosphoric acid, sodium phosphate, citric acid, sodium citrate and tartaric acid; anticorrosive agents such as ammonium nitrate and guanidine; and the like.

The fixing agents used in the bleach-fixing solution of the invention are water-soluble silver halide solubilizing agents such thiosulfats as sodium thiosulfate and ammonium thiosulfate; such thiocyanate as sodium thiocyanate and ammonium thiocyanate; such thioether compounds as ethylenebis(thioglycolic acid) and 3,6-dithia-1,8-octanediol; and thioureas, which may be used alone or in combination. Moreover, it is also possible to use a specific bleach-fixing solution, for instance, composed of a combination of fixing agents and a large amount of potassium iodide as disclosed in J.P. KOKAI No. 55-155354. In the invention, the use of thiosulfates, in particular, ammonium thiosulfate are preferred. The amount of the fixing agents used in preferably 0.3 to 2 moles, more preferably 0.5 to 1.0 mole per liter of the bleach-fixing solution. The pH value thereof preferably ranges from 3 to 10 and particularly 5 to 9.

The bleach-fixing solution may further comprise various fluorescent whiteners, antifoaming agents or surfactants, polyvinyl pyrrolidone, organic solvents such as methanol and the like.

The bleach-fixing solution may contain sulfite ion-releasing compounds such sulfites as sodium sulfite, potassium sulfite and ammonium sulfite; such bisulfites as ammonium bisulfite, sodium bisulfite and potassium bisulfite; and such metabisulfites as potassium metabisulfite, sodium metabisulfite and ammonium metabisulfite, as preservatives. The amount of these compounds is preferably about 0.02 to 0.50 mole/l and more preferably 0.04 to 0.40 mole/l expressed in the amount of sulfite ions.

Generally, sulfites are used as the preservatives, but it is also possible to use other preservatives such as ascorbic acid, carbonyl/bisulfite adducts, carbonyl compounds or sulfinic acids disclosed in J.P.A. No. 62-280810.

The bleach-fixing solution may optionally contain buffering agents, fluorescent whiteners, chelating agents, antifoaming agents, mold controlling agents and the like.

An important aspect of the present invention is to adjust the amount of ammonium ions present in the replenisher for the bleach-fixing process to at least 80 mole%, preferably 90 to 100 mole% of the whole non-metallic ions therein. Therefore, the aforementioned components for the bleach-fixing solution such as bleaching agents, bleaching accelerators, rehalogenating agents, pH buffering agents, fixing agents and preservatives in particular, bleaching agents, fixing agents and preservatives are preferably used in the form of ammonium salts and it is necessary to adjust the amount of ammonium ions to the foregoing range when the replenisher for bleach-fixing process is prepared. In order to attain such an ammonium ion concentration, the use of ferric ammonium aminopolycarboxylate, ammonium thiosulfate, ammonium sulfite and aqueous ammonia is particularly preferred. In this connection, the concentration of the foregoing components in the replenisher may be the same as that in the bleach-fixing bath or 1.2 to 4.0 times the latter.

Another important aspect of the method of this invention is to adjust the amount of replenisher for the bleach-fixing solution to 0.2 to 15 times, preferably 1.0 to 14 times, more preferably 2 to 10 times the volume of the solution carried over from the preceding bath by the processed light-sensitive material per unit area thereof. This leads to saving of resources, lowering of cost and prevention of environmental pollution. In this connection, where the amount of replenisher is lower than that as described above, there cannot be effectively prevented an increase of magenta stain. On the other hand, it is not preferable that the amount is higher than that as described above, since the stability of bleach-fixing solution becomes low and leuco dye of cyan coupler produces. The amount of replenisher is preferably 20 to 250 ml. Generally, the term "preceding bath" herein means the bath for color development and the amount of the color developer carried over therefrom varies dependant upon factors such as kinds of machines used, systems for transfer, strength of squeezing, but it is approximately 10 to 150 ml per 1 $m^2$ of the processed light-sensitive material and in most cases, in the order of 20 to 100 ml.

The aforesaid amount of replenisher include the amount of water for diluting and stabilizing the bleach-fixing solution, which is concentrated by evaporation, as well as the added amount of preservatives.

(Water Washing and Stabilization)

The amount of washing water may widely vary depending on various factors such as properties and applications of the processed light-sensitive material (which depend on, for instance, the materials such as couplers used); temperature of the washing water; the number of washing tanks (step number); methods for replenishing such as countercurrent flow system and direct flow system; and other various factors. Among these, the relation between the number of washing baths and the amount of water in the multistage countercurrent flow system can be determined by the method disclosed in Journal of the Society of Motion Picture and Television Engineers, Vol. 64, pp. 248–253 (May, 1955). Generally, the step number in the multistage countercurrent system is preferably 2 to 6, in particular, 2 to 4.

The multistage countercurrent system makes it possible to substantially reduce the amount of washing water, for instance, to not more than 0.5 to 1.0 liter and thereby noticeable effect of the invention can be ensured, while bacteria proliferate in the tanks because of increase in the residence time of water therein and as a result there are problems such that the resultant floating substances are adhered to the processed light-sensitive material. In order to settle the above problems, it is useful to employ the method for reducing the amount of calcium and magnesium described in U.S. Ser. No. 057,254 filed on June 3, 1987. The problem of proliferation of bacteria may also be solved by using antibacterial agents such isothiazolone compounds or thiabendazoles as disclosed in J.P. KOKAI No. 57-8542; such chlorine type antibacterial agents as sodium chlorinated isocyanurate disclosed in J.P. KOKAI No. 61-120145; such benzotriazoles as those disclosed in J.P. KOKAI No. 61-267761; copper ions; or other antibacterial agents disclosed in "BOKIN BOBAIZAI NO KAGAKU (Chemistry of Antibacterial and Antifungus agents)", Hiroshi HORIGUCHI; "BISEIBUTSU NO MEKKIN, SAKKIN AND BOBAI GIJUTSU (Sterilization, Pasteurization and Mold Controlling Techniques)", edited by Sanitary Engineering Society; and "Dictionary of Antibacterial and Antifungus agents", edited by Japan Bacteria and Fungi Controlling Society.

Moreover, the washing water may contain surfactants as a water drainage and chelating agents such as EDTA as a softener for hard water.

The stabilization process may be carried out directly without carrying out the water washing process or subsequent to the latter. The stabilization solutions contain compounds capable of stabilizing images, such aldehyde compounds as formalin; buffering agents for adjusting film pH to a value suitable for stabilizing dye images; and ammonium compounds. In order to prevent the proliferation of bacterial and impart the mold controlling property to the processed light-sensitive materials, the aforementioned antibacterial and mold controlling agents may be used.

These solutions may contain surfactants, fluorescent whiteners, and film hardening agents. When the stabilization process is directly carried out without carrying out water washing in the method of this invention, it is possible to use any known methods such as those disclosed in J.P. KOKAI Nos. 57-8543, 58-14834 and 60-220345.

Besides, in a preferred embodiment, chelating agents such as 1-hydroxyethylidene-1,1-diphosphonic acid and ethylenediaminetetramethylenephosphonic acid and magnesium and bismuth compounds may be used.

In the present invention, so-called rinsing solutions may likewise be employed instead of washing water or stabilization solution used after the desilvering process.

The pH value of washing water or stabilization solution is 4 to 10, preferably 5 to 8. The temperature thereof may vary depending on factors such as applications and properties of the light-sensitive material to be processed, but it is generally 15° to 45° C., preferably 20° to 40° C. The processing time is not critical, but it can be ensured to effectively prevent increase of magenta stain after processing when the processing time is established as short as possible. It is preferably 30 seconds to 2 minutes and more preferably 15 seconds to 1.5 minutes. The amount of these solutions replenished is preferably rather small from the viewpoint of running cost, reduction in the amount of waste liquor and handling properties and more excellent prevention of magenta stain can thereby be achieved. In addition, stability of the washing water and the stabilization solution greatly increase by using the bleach-fixing solution of this invention.

Specifically, the preferred amount thereof to be replenished is 0.5 to 50 times, more preferably 3 to 40 times the volume of the solution carried over from the preceding bath per unit area of the processed light-sensitive material. Alternatively, it is not more than one liter, preferably not more than 500 ml per 1 $m^2$ of the processed light-sensitive material. The replenishment thereof may be carried out continuously or periodically.

The used solutions for water washing and/or stabilization process may be recycled to the preceding process. One such example is to let the overflow of washing water, which is reduced by employing multistage countercurrent system, flow into the preceding bath or the bleach-fixing bath while replenishing a concentrate to the latter to reduce the amount of waste liquor.

The overall time required to carry out the desilvering, water washing and/or stabilization processes in the method of this invention is preferably not more than 4 minutes, more preferably 30 seconds to 3 minutes. The term "overall time" herein means the time required to transfer the light-sensitive material from the inlet of the first bath for desilvering process to the outlet of the last bath for water washing or stabilization, inclusive of the time required to transfer the material in the air between neighbouring baths.

It is unexpected that increase of magenta stain after processing can be effectively prevented in such rapid processing method that the overall time is not more than 4 minutes, and the advantages are estimated on the basis that residual concentration of the color developing agent of the photographic light-sensitive material becomes greatly low.

(Materials to be processed by the invention)

The method of the invention can be applied to any processings including the use of color developers. It can be applied to the processing of, for instance, color paper, color reversal paper, color direct positive light-sensitive materials, color positive films, color negative films and color reversal films and in particular color paper, color reversal paper and color direct positive light-sensitive materials.

The silver halide emulsion for use in making light-sensitive materials to be processed by the invention may have any silver halide compositions such as those containing silver iodobromide, silver bromide, silver chlorobromide and silver chloride. For instance, when a rapid processing or replenisher-saved processing of light-sensitive materials such as color paper is required, a silver chlorobromide emulsion having silver chloride content of not less than 60 mole% or silver chloride emulsion is preferred and particularly such an emulsion having the silver chloride content of 80 to 100 mole% is preferred. Alternatively, if high sensitivity is required and it is required to hold particularly low fog during preparation, storage and/or processing, it is preferred to use silver chlorobromide emulsions having the silver bromide content of not less than 50 mole% or silver bromide emulsions which may contain no more than 3 mole% of silver iodide and more preferably those containing not less than 70 mole% of silver bromide. The color light-sensitive materials for taking photographs are preferably prepared from silver iodobromide or silver chloroiodobromide emulsions in which the content of silver iodide is preferably 3 to 15 mole%.

In the present invention, the coated amount of silver halide emulsions expressed in the amount of elemental silver is preferably as low as possible. In particular, when it is not more than 0.8 g/$m^2$, magenta stain can be effectively prevented and desilvering properties greatly increase.

The grains of silver halide used in the invention may have different phases in the inner part and the outer part; may have multiphase structure such as those having contact crystal structures; or may be composed of a uniform phase. Moreover, they may be composed of a combination thereof.

The size distribution of the silver halide grains may be wide or narrow, but it is preferred to use, in the invention, so-called monodisperse silver halide emulsions in which the value (rate of variation) of the standard deviation in the size distribution curve of the silver halide emulsion divided by average grain size is not more than 20% and preferably not more than 15%. Moreover, in order to impart the desired gradation to the light-sensitive materials, it is possible, in the emulsion layers having substantially the same color-sensitivity, to use a mixture of at least two monodisperse silver halide emulsions (preferably those having the foregoing rate of variation) having different grain sizes in a single layer or these monodisperse emulsions may be coated in a multilayered structure as different layers. Alternatively, at least two polydisperse silver halide emulsions or a combination of monodisperse and polydisperse silver halide emulsions may be used in a single layer or multilayered structure.

The silver halide grains used in the invention may be in the regular crystal forms such as cubic, octahedral, rhombo dodecahedral and tetradecahedral forms; or in the irregular crystal forms such as spheric form; or further in the composite forms thereof. They may be plate-like grains and in particular an emulsion in which at least 50% of the whole projected areas of the grains included are occupied by plate-like grains having length/thickness ratio of 5 to 8 or not less than 8 can be used. The emulsions may composed of a combination of grains having different crystal forms.

These various emulsions may be those containing surface latent image-forming type grain or internal latent image-forming type grain.

The photographic emulsions used in the invention may be prepared by the methods disclosed in Research Disclosure, Vol. 170, No. 17643 (Items I, II and III) (December, 1978).

The emulsions used in the invention are generally physically or chemically ripened and spectrally sensitized before use. The additives used in such processes are disclosed in Research Disclosure, Vol. 176, No. 17643 (December, 1978) and ibid, Vol. 187, 18716 (November, 1979) and the relevant passages are listed in the following Table.

Known additives for photographic paper used in the invention are also disclosed in aforesaid two articles (Research Disclosure) and the relevant passages are also listed in the following Table.

| Kind of Additive | RD17643 | RD18716 |
|---|---|---|
| 1. Chemical sensitizer | p 23 | p 648, right column |
| 2. Sensitivity enhancing agent | | p 648, right column |
| 3. Spectral sensitizing agent | p 23–24 | p 648, right column |
| 4. Supersensitizing agent | | p 649, right column |
| 5. Whitener | p 24 | p 699, right column |
| 6. Antifoggant, stabilizer | p 24–25 | p 649, right column |
| 7. Coupler | p 25 | |
| 8. Organic solvent | p 25 | |
| 9. Light absorber, filter dye | p 25–26 | p 649, right column to p 650, left column |
| 10. Ultraviolet absorber | p 25–26 | p 649, right column to p 650, left column |
| 11. Stain resistant agent | p 25, right column | p 650, left to right column |
| 12. Dye image stabilizer | p 25 | |
| 13. Hardening agent | p 26 | p 651, left column |
| 14. Binder | p 26 | p 651, left column |
| 15. Plasticizer, lubricant | p 27 | p 650, right column |
| 16. Coating aid, surfactant | p 26–27 | p 650, right column |
| 17. Antistatic agent | p 27 | p 650, right column |

The light-sensitive materials to be processed by the invention may contain various color couplers. The term "color coupler(s)" as used herein means compounds capable of forming dyes through a coupling reaction with an oxidized form of an aromatic primary amine developing agent. Typical examples of color couplers useful in the invention include naphtholic or phenolic compounds, pyrazolone or pyrazoloazole type compounds and linear or heterocyclic ketomethylene compounds. Specific examples of these cyan-magenta- and yellow-couplers usable in the invention are disclosed in the patents cited in Research Disclosure No. 17643 (December, 1978), VII-D; and No. 18717 (November, 1979).

Color couplers included in the light-sensitive materials are preferably made non-diffusible by imparting thereto ballast groups or polymerizing them. 2-Equivalent color couplers in which the active site for coupling is substituted with an elimination group are rather preferred than 4-equivalent color couplers in which the active site for coupling is hydrogen atom, this is because the amount of coated silver may, thereby, be reduced. Moreover, couplers in which a formed dye has a proper diffusibility, non-color couplers, DIR couplers which can release a development inhibitor through the coupling reaction or couplers which can release a development accelerator may also be used.

Typical yellow couplers usable in the invention are acrylacetamide type couplers of an oil protect type. Examples of such yellow couplers are disclosed in U.S. Pat. Nos. 2,407,210; 2,875,057; and 3,265,506. 2-Equivalent yellow couplers are preferably used in the invention. Typical examples thereof are the yellow couplers of an oxygen atom elimination type disclosed in U.S. Pat. Nos. 3,408,194; 3,447,928; 3,933,501 and 4,022,620, or the yellow couplers of a nitrogen atom elimination type disclosed in J.P. KOKOKU No. 55-10739, U.S. Pat. Nos. 4,401,752 and 4,326,024, Research Disclosure No. 18053 (April, 1979). U.K. Patent No. 1,425,020, DEOS Nos. 2,219,917; 2,261,361; 2,329,587 and 2,433,812. Alpha-pivaloyl acetanilide type couplers are excellent in fastness, particularly light fastness, of formed dye. On the other hand, alpha-benzoyl acetanilide type couplers yield high color density.

Magenta couplers usable in the invention include couplers of an oil protect type of indazolone, cyanoacetyl, or preferably pyrazoloazole type ones such as 5-pyrazolnes and pyrazolotriazoles. Among 5-pyrazolone type couplers, couplers whose 3-position is substituted with an arylamino or acylamino group are preferred from the viewpoint of color phase and color density of the formed dye. Typical examples thereof are disclosed in U.S. Pat. Nos. 2,311,082; 2,343,703; 2,600,788; 2,908,573; 3,062,653; 3,152,896 and 3,936,015. An elimination group of the 2-equivalent 5-pyrazolone type couplers is preferably a nitrogen atom elimination group described in U.S. Pat. No. 4,310,619 and an arylthio group described in U.S. Pat. No. 4,351,897. The 5-pyrazolone couplers having ballast groups such as those described in European Patent No. 73,636 provide high color density.

As examples of pyrazoloazole type couplers, there may be mentioned such pyrazolobenzimidazoles as those disclosed in U.S. Pat. No. 3,369,879, preferably such pyrazolo(5,1-c) (1,2,4)triazoles as those disclosed in U.S. Pat. No. 3,725,067, such pyrazolotetrazoles as those disclosed in Research Disclosure No. 24220 (June, 1984) and such pyrazolopyrazoles as those disclosed in Research Disclosure No. 24230 (June, 1984).

As the magenta couplers in the light-sensitive material to be treated by the invention, if those represented by the following general formula (I) or (II) are used, the stain resistant effect would be further enhanced:

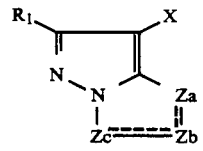

(I)

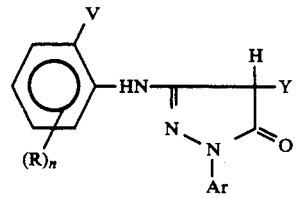

(II)

In the general formula (I), $R_1$ represents a hydrogen atom or a substituent; X represents a hydrogen atom or a group which may be eliminated through a coupling reaction with an oxidized form of an aromatic primary amine developing agent; Za, Zb and Zc represent a methine, a substituted methine, =N— or —NH—, provided that one of the bonds Za-Zb and Zb-Zc is a double bond while the other is a single bond, that if Zb-Zc bond is a carbon-carbon bond, this may be a part of an aromatic ring, that these may form a dimer or a higher polymer at $R_1$ or X and that if Za, Zb or Zc is a substituted methine, these may form a dimer or a higher polymer at the substituted methine.

In the general formula (II), Ar is a phenyl group which may be substituted; Y represents a group which is eliminated when the coupler causes coupling reaction with an oxidized form of an aromatic primary amine developing agent to form a dye; V is a halogen atom, an alkoxy group or an alkyl groupl R represents a group which may be substituted on a benzene ring provided that if n is 2, R may be the same or different; and n is an integer of 1 or 2.

The magenta couplers represented by the formula (I) are disclosed in J.P. KOKAI No. 62-30250 and these couplers can be usable in the invention.

In the formula (I), the term "higher polymer" means those having not less than 2 groups represented by the formula (I) per molecule and includes dimeric and polymeric couplers. The "polymeric couplers" may be homopolymers simply composed of the monomeric units having the moiety represented by the formula (I) (preferably those having vinyl groups, hereunder referred to as "vinyl monomer") or a copolymers thereof with non-dye-forming ethylenically unsaturated monomers which do not cause coupling reaction with the oxidized form of the aromatic primary amine developing agent.

The compounds represented by the formula (I) are condensed 5-membered ring/5-membered ring nitrogen-containing heterocyclic couplers and the coupling nucleus thereof exhibits aromaticity electrically equivalent to that of naphthalene. The compounds have a structure known generically as azapentalene. Preferred examples thereof are 1H-imidazo(1,2-b)pyrazoles, 1H-pyrazolo(1,5-b)pyrazoles, 1H-pyrazolo(5,1-c)(1,2,4)triazoles, 1H-pyrazolo(1,5-b)(1,2,4)triazoles, 1H-pyrazolo(1,5-d)tetrazoles and 1H-pyrazolo(1,5-a)benzimidazoles which are respectively represented by the following general formulas (Ia) to (If). Particularly preferred examples are those represented by the formulas (Ia), (Ic) and (Id), more preferably (Id).

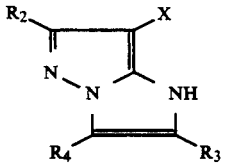

(Ia)

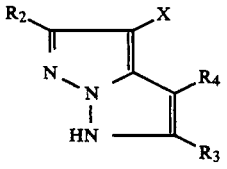

(Ib)

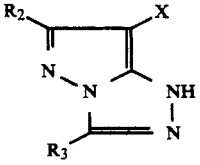

(Ic)

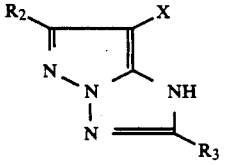

(Id)

-continued

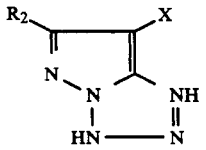

(Ie)

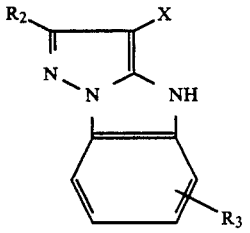

(If)

In the general formulas (Ia) to (If), the substituents $R_2$ to $R_4$ may be the same or different and independently represent a hydrogen atom, a halogen atom, an alkyl group, an aryl group, a heterocyclic group, a cyano group, an alkoxy group, an aryloxy group, a heterocycloxy group, an acyloxy group, a carbamoyloxy group, a silyloxy group, a sulfonyloxy group, an acylamino group, an anilino group, an ureido group, an imido group, a sulfamoylamino group, a carbamoylamino group, an alkylthio group, an arylthio group, a heterocyclothio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group; X represents a hydrogen atom, a halogen atom, a carboxyl group, or a group which is bonded to the carbon atom at the coupling position through an oxygen, nitrogen or sulfur atom and can be eliminated through the coupling reaction.

$R_2$, $R_3$, $R_4$ or X may be a bivalent group to form bisproducts. Moreover, if the parts represented by the formulas (Ia) to (If) are moieties of vinyl monomers, one of $R_2$ to $R_4$ represents a single bond or a linking group through which the vinyl group and moieties (Ia) to (If) are bonded together. $R_2$ to $R_4$ are detailed in J.P. KOKAI No. 62-30250.

X represents a hydrogen atom, a halogen atom, a carboxyl group, a group linked through an oxygen atom, such as an acetoxy group; a group linked through a nitrogen atom, such as benzenesulfonamido and N-ethyl-toluenesulfonamido groups; or a group linked through a sulfur atom, such as phenylthio, 2-carboxyphenylthio and 2-butoxy-5-tert-octylphenylthio groups.

When $R_2$, $R_3$, $R_4$ or X is a bivalent group to form bisproducts, examples of such bivalent groups are substituted or unsubstituted alkylene groups such as methylene, ethylene 1,10-decylene and $—CH_2CH_2—O—CH_2CH_2—$ groups; substituted or unsubstituted phenylene groups such as 1,4-phenylene, 1,3-phenylene,

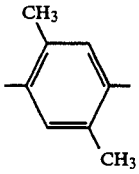

and

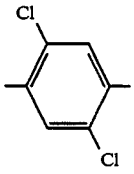

and —NHCO—$R_5$—CONH— (wherein $R_5$ represents a substituted or unsubstituted alkylene or phenylene group).

When the moieties represented by the formulas (Ia) to (If) are included in the vinyl monomers, examples of the linking group represented by $R_2$, $R_3$ or $R_4$ are those formed by the combining the groups selected from the group consisting of: alkylene groups such as substituted or unsubstituted alkylene groups (e.g., methylene, ethylene, 1,10-decylene and $—CH_2CH_2—O—CH_2CH_2—$), phenylene groups such as substituted or unsubstituted phenylene groups, e.g., 1,4-phenylene, 1,3-phenylene,

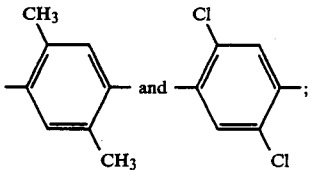

—NHCO—, —CONH—, —O—, —OCO— and aralkylene groups such as

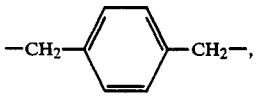

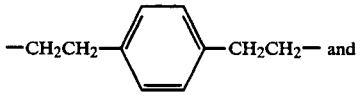

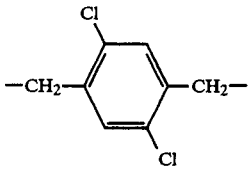

The vinyl monomers may have substituents other than those represented by the formulas (Ia) to (If). Preferred examples of such substituents include a hydrogen atom, a chlorine atom or a lower alkyl group having 1 to 4 carbon atoms.

Examples of the monomers which do not cause coupling reaction with the oxidized product of an aromatic primary amine developing agent are acrylic acid, alpha-chloroacrylic acid, alpha-alacrylic acids such as methacrylic acid, or esters or amides derived from these acrylic acids, such as acrylamide, diacetone acrylamide, methacrylamide, methyl acrylate, tert-butyl acrylate, lauryl acrylate, ethyl methacrylate, n-butyl methacrylate and beta-hydroxymethacrylate, methylene bisacrylamide, vinyl esters such as vinyl acetate, vinyl propionate and vinyl laurate, acrylonitrile, methacrylonitrile, aromatic vinyl compounds such as styrene and derivatives thereof, vinyltoluene, divinylbenzene, vinylacetophenone and sulfostyrene; itaconic acid, citraconic acid, crotonic acid, vinylidene chloride, vinyl alkyl ethers such as vinyl ethyl ether; maleic acid, maleic anhydride, maleates, N-vinyl-2-pyrrolidone, N-vinylpyridine and 2- and 4-vinylpypyridine, which may be used alone or in combination.

Examples of the couplers represented by the formulas (Ia) to (If) and methods for preparing these are disclosed in the following articles:

Compounds (Ia) are disclosed in, for instance, J.P. KOKAI No. 59-162548; compounds (Ib) in J.P. KOKAI No. 60-43659; compounds (Ic) in J.P. KOKOKU No. 47-27411; compounds (Id) in J.P. KOKAI Nos. 59-171956 and 60-172982; compounds (Ie) in J.P. KOKAI No. 60-33552; and compounds (If) in U.S. Pat. No. 3,061,432.

The ballast groups exhibiting high coloring properties disclosed in J.P. KOKAI Nos. 58-42045, 59-214854, 59-177553, 59-177544 and 59-177557 may be applied to any of compounds (Ia) to (If).

Specific examples of the compounds represented by the foregoing general formula (I) are M-1 to M-67 or a mixture thereof disclosed in J.P. KOKAI No. 62-30250, however, particularly preferred are those listed below and those used in Examples.

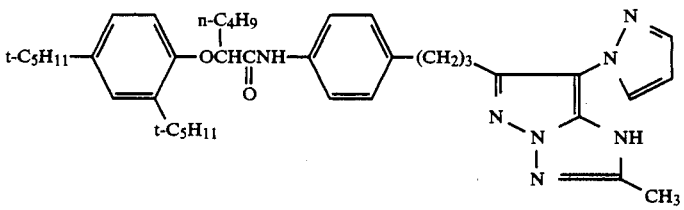

(M-1)

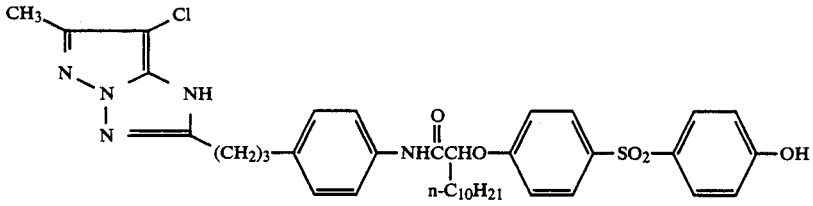

(M-2)

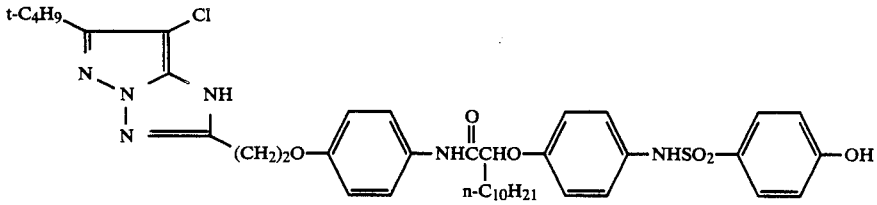

(M-3)

-continued
(M-4)
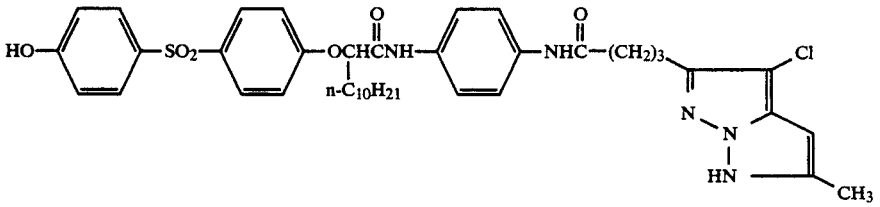
(M-5)
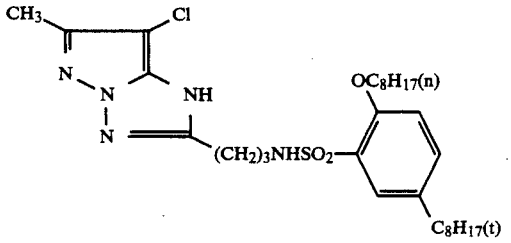
(M-6)
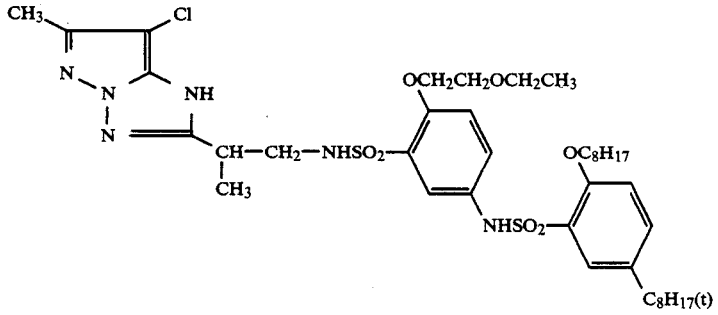
(M-7)
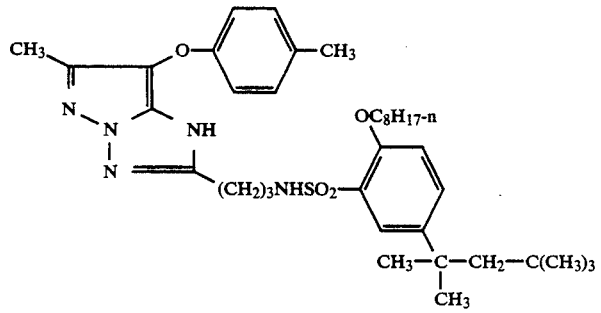
(M-8)
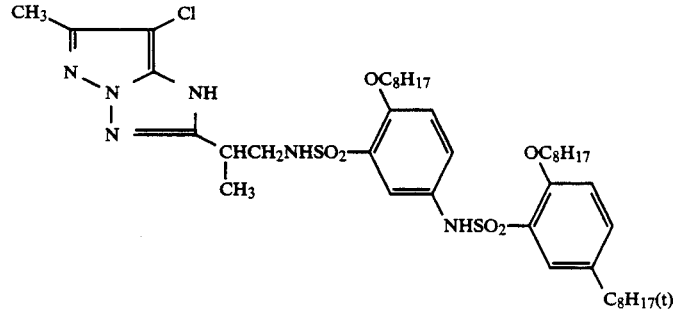

-continued
(M-9)
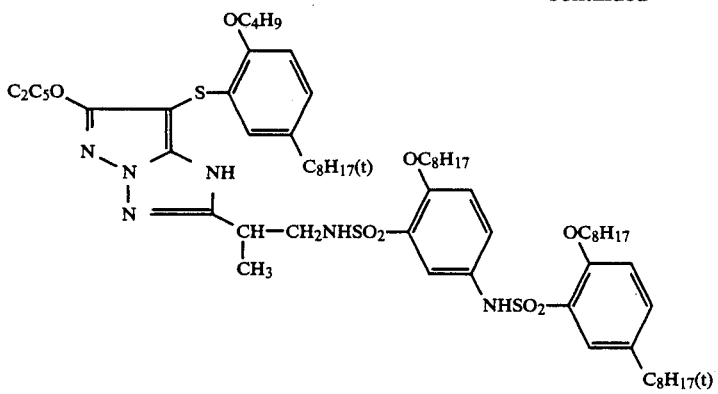
(M-10)
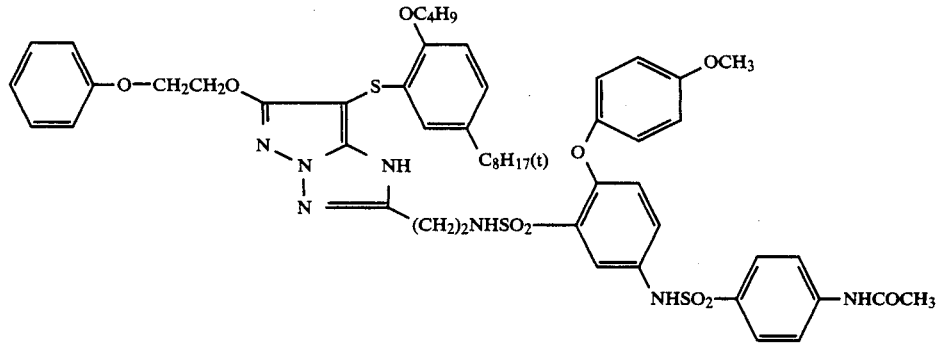
(M-11)
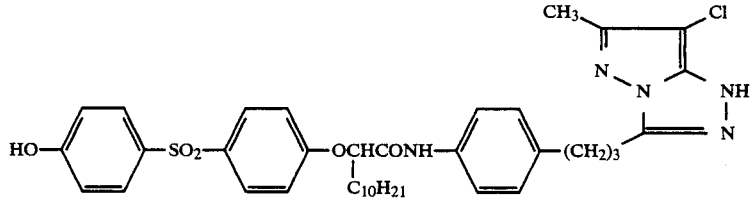
(M-12)
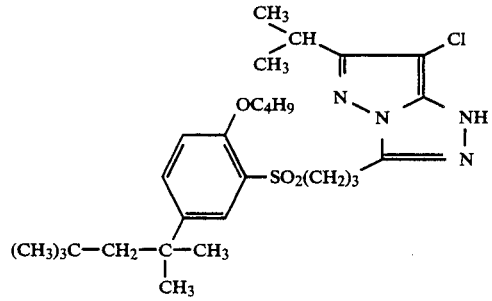
(M-13)
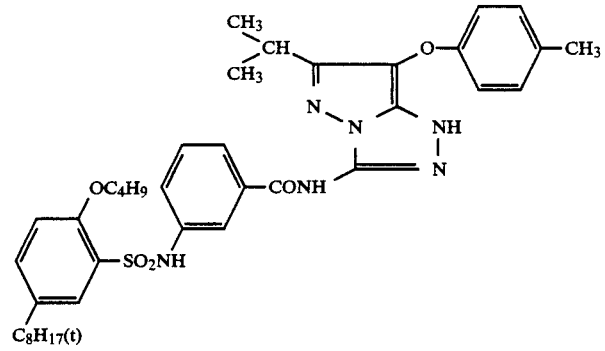

-continued
(M-14)
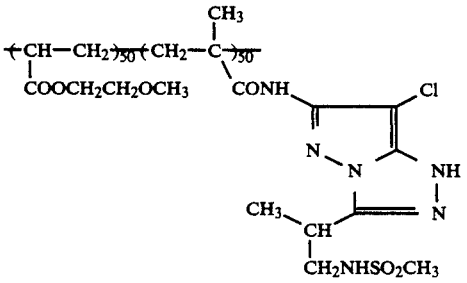
(M-15)
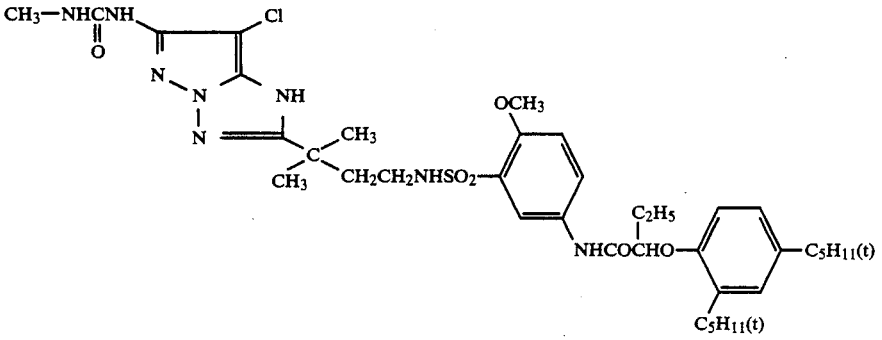
(M-16)
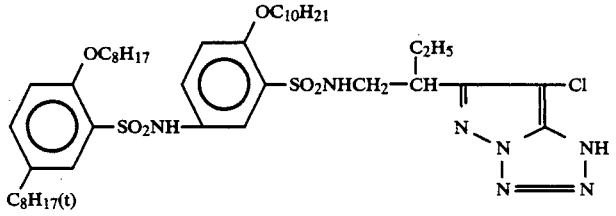
(M-17)
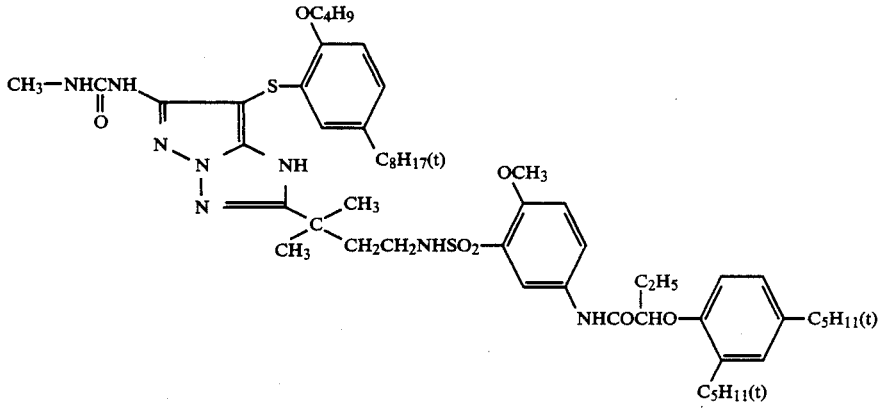
(M-18)
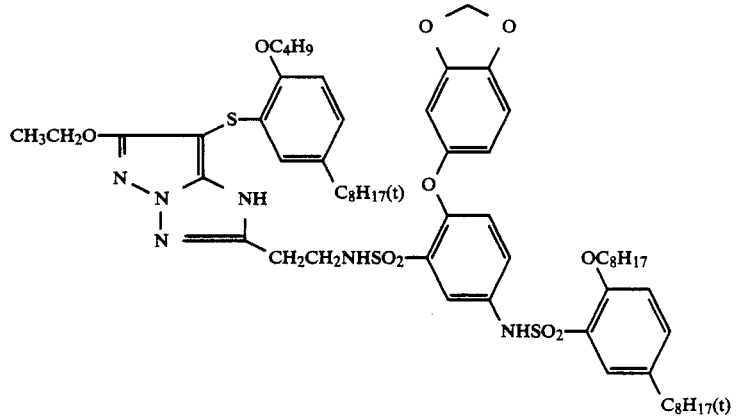

-continued

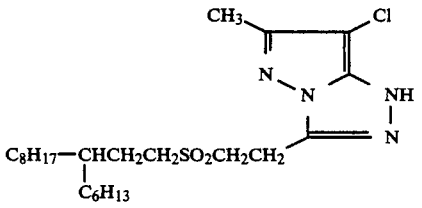

(M-19)

As the magenta couplers represented by the formula (II), there may be used those disclosed in J.P. KOKAI Nos. 60-252161 and 60-238832.

In the formula (II), Ar represents a phenyl group, particularly a substituted phenyl group. Examples of the substituents are halogen atoms, alkyl groups preferably having 1 to 5 carbon atoms, alkoxy groups preferably having 1 to 5 carbon atoms, aryloxy groups, alkoxycarbonyl groups, cyano group, carbamoyl group, sulfamoyl group, sulfonyl group, sulfonamido group and acrylamino group. The phenyl group may have 2 or more of these substituents. Preferred substituents are halogen atoms and in particular chlorine atom.

Y represents a group which is eliminated when the coupler causes coupling reaction with the oxidized form of an aromatic primary amine developing agent to form a dye. Specific examples of Y is a halogen atom, an alkoxy group, an aryloxy group, an acryloxy group, an arylthio group, an alkylthio group, or a group represented by the formula:

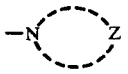

wherein Z denotes an atomic group required to form 5- or 6-membered ring together with the nitrogen atom and an atom selected from the group consisting of carbon, oxygen, nitrogen and sulfur atoms.

V represents a halogen atom, an alkoxy group or an alkyl group. Preferred alkyl and alkoxy groups are those having 1 to 5 carbon atoms. Preferred are halogen atoms, in particular chlorine atom.

R represents a group which may be substituted on the benzene ring and n is an integer of 1 or 2. If n is 2, two substituents R may be the same or different.

Examples of the group which may be substituted on the benzene ring include halogen atoms, R'—, R'O—, R'—CO—NR''—, R'—$SO_2$—NR''—, R''—O—CO—NR''—, R'COO—, R'NR''—CO—, R'—NR''—$SO_2$—, R'O—CO—, R'—NR''—CO—NR'''— and a group represented by the formula (a):

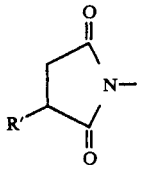

(a)

wherein R', R'', and R''' may be the same or different and each represents a hydrogen atom or an alkyl, alkenyl or aryl group optionally having substituents. Preferred groups are R'—CONH—, R'—$SO_2$NH— and group (a).

Specific examples of the magenta couplers represented by the formula (II) include M-1 to M-37 disclosed in J.P. KOKAI No. 60-262161 and M-1 to M-34 disclosed in J.P. KOKAI No. 60-238832 and a mixture thereof. Preferred are those listed below and those used in Examples.

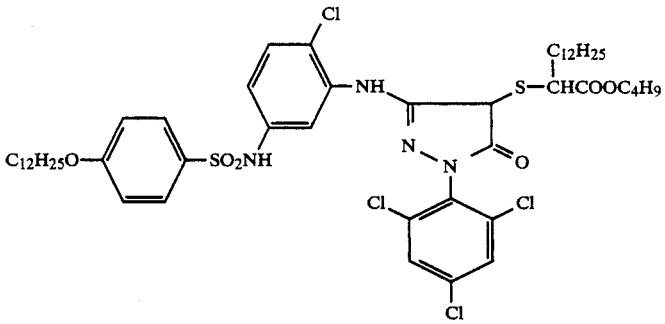

m-1

-continued
m-2
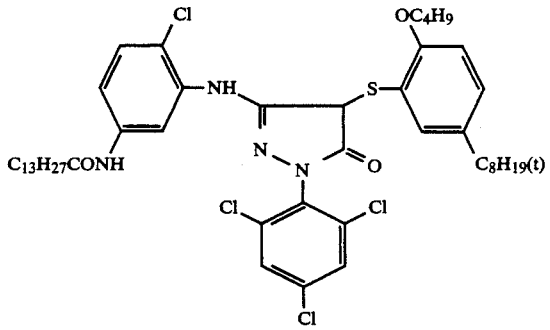
m-3
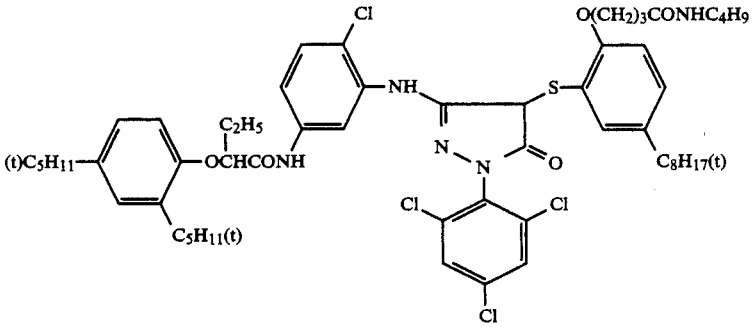
m-4
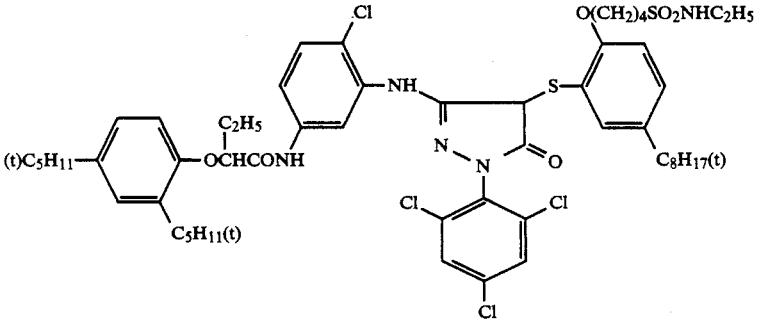
m-5
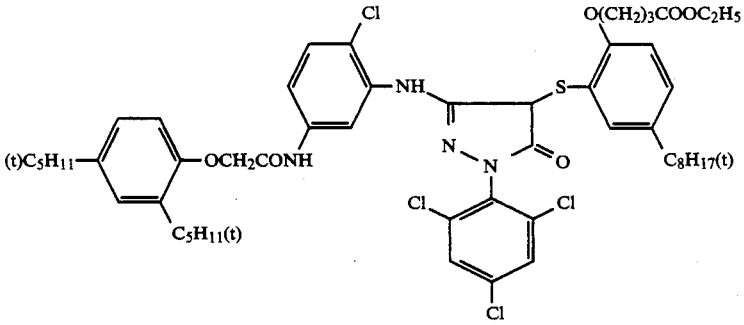
m-6
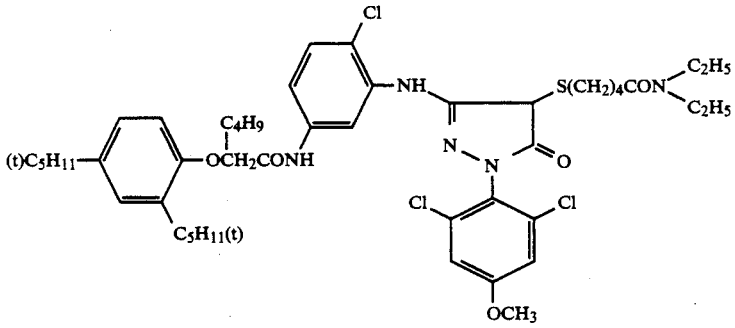

-continued
m-7
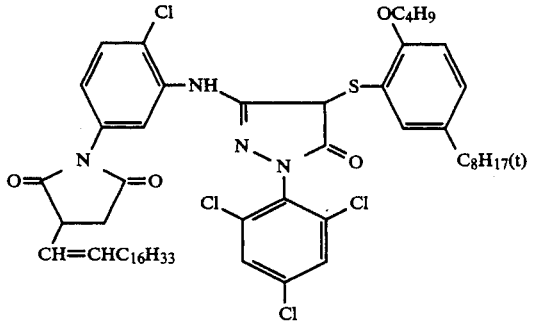
m-8
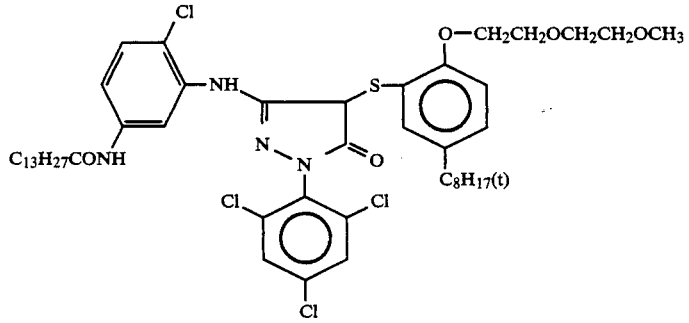
m-9
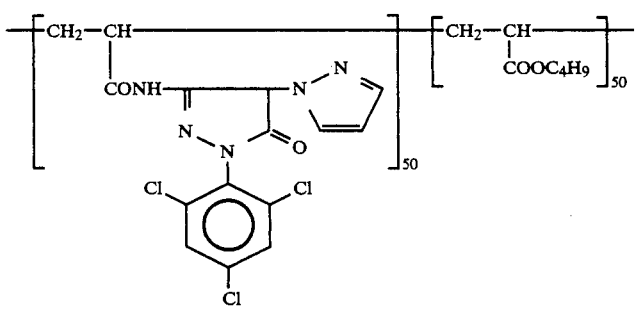
m-10
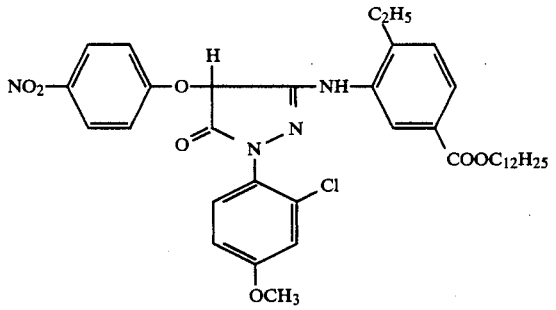
m-11
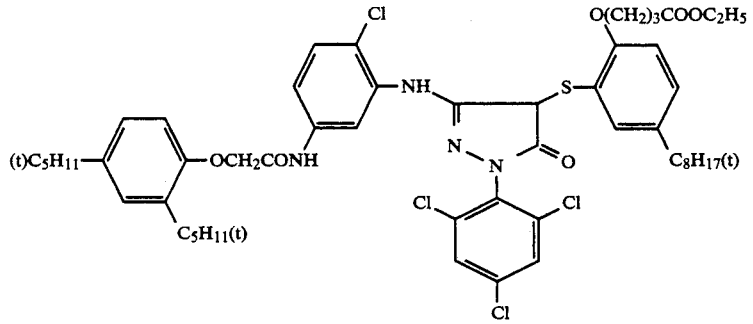

-continued m-12

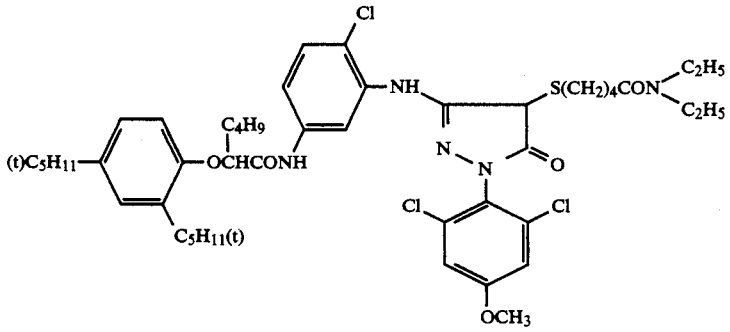

Cyan couplers usable in the invention include naphtholic or phenolic couplers of an oil protect type. Typical examples of naphthol type couplers are those disclosed in U.S. Pat. No. 2,474,293. Typical preferred 2-equivalent naphtholic couplers of oxygen atom elimination type are disclosed in U.S. Pat. Nos. 4,052,212; 4,146,396; 4,228,233; and 4,296,200. Exemplary phenol type couplers are those disclosed in U.S. Pat. Nos. 2,369,929; 2,801,171; 2,772,162 and 2,895,826.

Cyan couplers resistant to humidity and heat are preferably used in the invention. Examples of such couplers are phenol type cyan couplers having an alkyl group higher than methyl group at a metha-position of a phenolic nucleus as described in U.S. Pat. No. 3,772,002; 2,5-diacylamino-substituted phenol type couplers as described in U.S. Pat. Nos. 2,772,162; 3,758,308; 4,126,396; 4,334,011 and 4,327,173; DEOS No. 3,329,729; and J.P. KOKAI No. 59-166956; and phenol type couplers having a phenylureido group at 2-position and an acylamino group at 5-position of the phenol nucleus as described in U.S. Pat. Nos. 3,446,622; 4,333,999; 4,451,559; and 4,427,767.

Graininess may be improved by using together a coupler which can form a dye having a moderate diffusibility. As such dye-forming couplers, some magenta couplers are specifically described in U.S. Pat. No. 4,366,237 and U.K. Pat. No. 2,125,570 and some yellow, magenta and cyan couplers are specifically described in European Pat. No. 96,570 and DEOS No. 3,234,533.

Dye-forming couplers and the aforementioned special couplers may be a dimer or a higher polymer. Typical examples of such polymerized dye-forming couplers are described in U.S. Pat. Nos. 3,451,820 and 4,080,211. Examples of such polymerized magenta couplers are described in U.K. Pat. No. 2,102,173 and U.S. Pat. No. 4,367,282.

In the present invention, at least two such couplers may be added to a single layer or one such coupler may be added to two or more different layers to impart desired properties to the light-sensitive materials.

The standard amount of the color couplers is 0.001 to 1 mole per mole of light-sensitive silver halide and preferably 0.01 to 0.5 moles for yellow couplers; 0.003 to 0.3 moles for magenta couplers and 0.002 to 0.3 moles for cyan couplers.

The couplers used in the invention can be introduced, into the light-sensitive materials, by a variety of known methods for dispersion. Examples of high boiling point organic solvents used in the oil-in-water dispersion method are disclosed in U.S. Pat. No. 2,322,027. Specific examples of processes, effects and latexes for impregnation for latex dispersion method are, for instance, disclosed in U.S. Pat. No. 4,199,363 and DE OLS Nos. 2,541,274 and 2,541,230.

The light-sensitive materials used in the invention are applied to the surface of a substrate commonly used such a flexible substrate as a plastic film (e.g., cellulose nitrate, cellulose acetate and polyethylene terephthalate) and paper or such a rigid substrate as a glass plate. Substrates and coating methods are detailed in Research Disclosure, Vol. 176, Item 17643 XV (p 27) and XVII (p 28) (December, 1978).

In the invention, reflecting substrates are preferably used. The "reflecting substrate" herein means a substrate having improved reflective power and makes the dye images formed on silver halide emulsion layer clear. Examples of such substrates include those covered with a hydrophobic resin film including a reflective material dispersed therein, such as titanium oxide, zinc oxide, calcium carbonate and calcium sulfate and those composed of such a hydrophobic resin including a dispersed reflective material.

As explained above in detail, the method of the present invention for processing silver halide color photographic light-sensitive materials makes it possible to substantially reduce the magenta stains formed after processing due to the magenta couplers used, by limiting the amount of replenisher for the bleach-fixing process to a specific value and simultaneously adjusting the amount of ammonium ions in the replenisher for the bleach-fixing process to a specific level.

The present invention will hereunder be explained in more specifically with reference to the following nonlimitative working examples and the effects practically attained will be also discussed comparing with those of Comparative Examples.

EXAMPLE 1

Multilayered photographic paper having the following layer structures were produced by applying coating solutions to the surface of a paper substrate of which both sides had been laminated with polyethylene films. The coating solutions were prepared as follows:

(Preparation of the Coating Solution for 1st Layer)

To yellow couplers ExY-1 and ExY-2 (10.2 g and 9.1 g respectively) and 4.4 g of a dye image stabilizer (Cpd-1) there were added 27.2 cc of ethyl acetate and 7.7 cc (8.0 g) of a high boiling point solvent (Solv-1) to dissolve them and the resulting solution was dispersed in 185 cc of 10% aqueous gelatin solution containing 8 cc of 10% sodium dodecylbenzene sulfonate to form an emulsion. The emulsion was mixed with and dispersed in emulsions EM 1 and EM 2 and the concentration of gelatin was adjusted so as to be consistent with the following composition to obtain the coating solution for 1st layer. The coating solutions for 2nd to 7th layers were also prepared in the same manner. To each layer, sodium salt of 1-oxy-3,5-dichloro-s-triazine was added as a gelatin hardening agent. Moreover, Cpd-2 was used as a thickening agent.

(Layer Structure)

The composition of each layer is given below. Numerical values represent coated amount expressed in $g/m^2$. The amount of silver halide emulsion is expressed in the amount of silver.

Substrate

Paper laminated with polyethylene films (the polyethylene film on the side of the 1st layer includes a white pigment ($TiO_2$) and a bluing dye).

| | |
|---|---|
| 1st Layer: Blue-sensitive Emulsion Layer | |
| Monodisperse silver chlorobromide emulsion spectrally sensitized with sensitizing dye ExS-1 (EM-1) | 0.13 |
| Monodisperse silver chlorobromide emulsion spectrally sensitized with sensitizing dye ExS-1 (EM-2) | 0.13 |
| Gelatin | 1.86 |
| Yellow coupler ExY-1 | 0.44 |
| Yellow coupler ExY-2 | 0.39 |
| Color image stabilizer Cpd-1 | 0.19 |
| Solvent Solv-1 | 0.35 |
| 2nd Layer: Color Mixing Inhibiting Layer | |
| Gelatin | 0.99 |
| Color mixing inhibitor Cpd-3 | 0.08 |
| 3rd Layer: Green-sensitive Emulsion Layer | |
| Monodisperse silver chlorobromide emulsion spectrally sensitized with sensitizing dye ExS-2,3 (EM-3) | 0.05 |
| Monodisperse silver chlorobromide emulsion spectrally sensitized with sensitizing dye ExS-2,3 (EM-4) | 0.11 |
| Gelatin | 1.80 |
| Magenta coupler ExM-1 | 0.39 |
| Color image stabilizer Cpd-4 | 0.20 |
| Color image stabilizer Cpd-5 | 0.02 |
| Color image stabilizer Cpd-6 | 0.03 |
| Solvent Solv-2 | 0.12 |
| Solvent Solv-3 | 0.25 |
| 4th Layer: Ultraviolet Absorbing Layer | |
| Gelatin | 1.60 |
| Ultraviolet absorber (Cpd-7/Cpd-8/Cpd-9 | 0.70 |

-continued

| | |
|---|---|
| = 3/2/6: weight ratio) | |
| Color mixing inhibitor Cpd-10 | 0.05 |
| Solvent Solv-4 | 0.27 |
| 5th Layer: Red-sensitive Emulsion Layer | |
| Monodisperse silver chlorobromide emulsion spectrally sensitized with sensitizing dye ExS-4,5 (EM-5) | 0.07 |
| Monodisperse silver chlorobromide emulsion spectrally sensitized with sensitizing dye ExS-4,5 (EM-6) | 0.16 |
| Gelatin | 0.92 |
| Cyan coupler ExC-1 | 0.32 |
| Color image stabilizer (Cpd-8/Cpd-9/Cpd-12 = 3/4/2: weight ratio) | 0.17 |
| Polymer for dispersion Cpd-11 | 0.28 |
| Solvent Solv-2 | 0.20 |
| 6th Layer: Ultraviolet Absorbing Layer | |
| Gelatin | 0.54 |
| Ultraviolet absorber (Cpd-7/Cpd-9/Cpd-12 = 1/5/3: weight ratio) | 0.21 |
| Solvent Solv-2 | 0.08 |
| 7th Layer: Protective Layer | |
| Gelatin | 1.33 |
| Acryl modified copolymer of polyvinyl alcohol (degree of modification = 17%) | 0.17 |
| Liquid paraffin | 0.03 |

In this case, Cpd-13 and Cpd-14 were used as irradiation inhibiting dyes.

In addition to the foregoing components, each layer contained Alkanol XC (available from Dupont Co., Ltd.), sodium alkylbenzenesulfonate, succinate and Magefacx F-120 (available from DAINIPPON INK AND CHEMICALS, INC.) as an emulsifying and dispersing agent and a coating aid. Moreover, Cpd-15 and 16 were used as stabilizers for silver halide.

The details of the emulsions used are as follows:

| Emulsion | Grain Size (micron) | Br Content (mole %) | Coefficient of Variation |
|---|---|---|---|
| EM-1 | 1.0 | 80 | 0.08 |
| EM-2 | 0.75 | 80 | 0.07 |
| EM-3 | 0.5 | 83 | 0.09 |
| EM-4 | 0.4 | 83 | 0.10 |
| EM-5 | 0.5 | 73 | 0.09 |
| EM-6 | 0.4 | 73 | 0.10 |

The structural formulas of the compounds used in this Example are as follows:

ExY-1

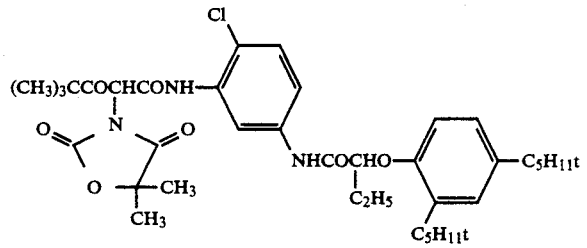

-continued
ExY-2
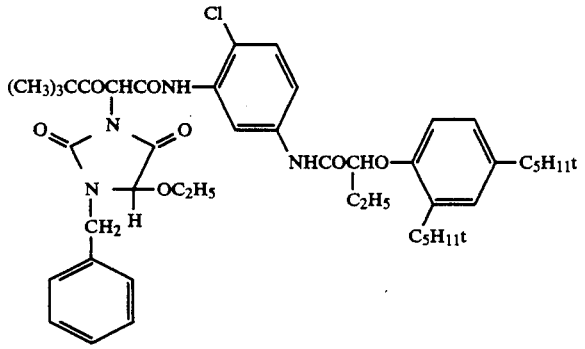
ExM-1
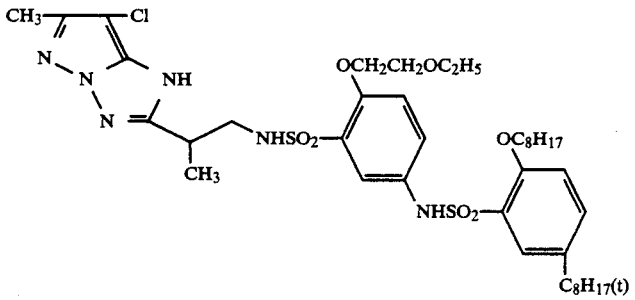
ExC-1
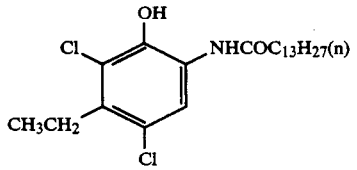
ExS-1
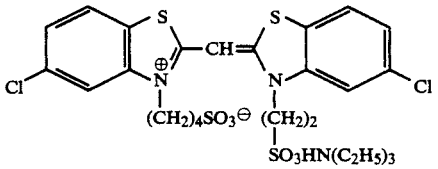
ExS-2
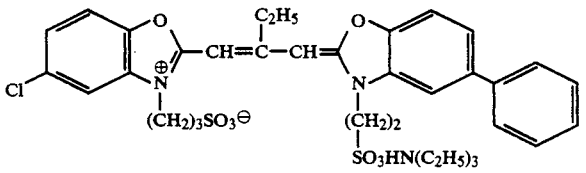
ExS-3
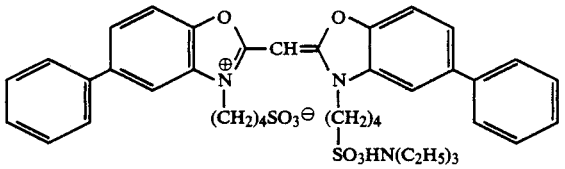
ExS-4
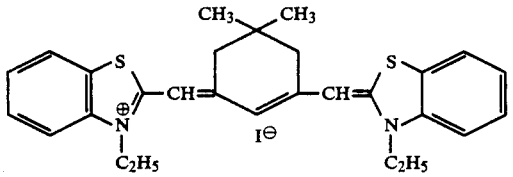

-continued
ExS-5
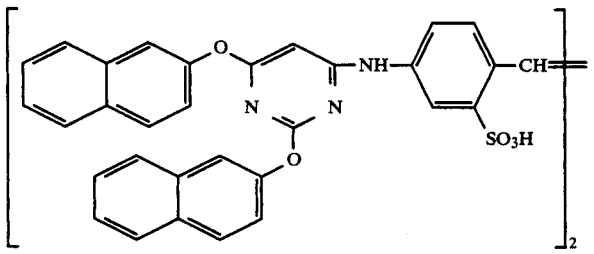
Cpd-1
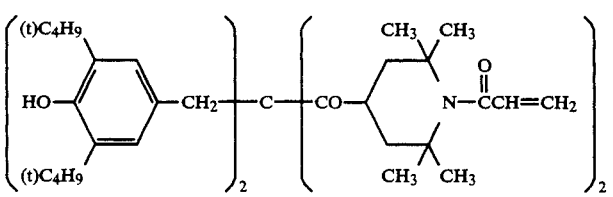
Cpd-2
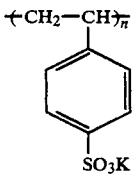
Cpd-3
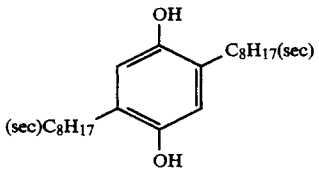
Cpd-4
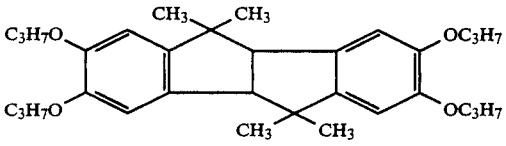
Cpd-5
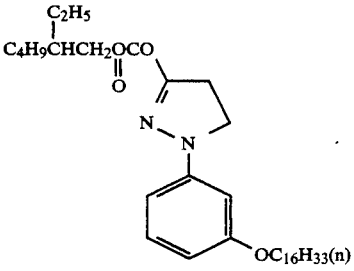
Cpd-6
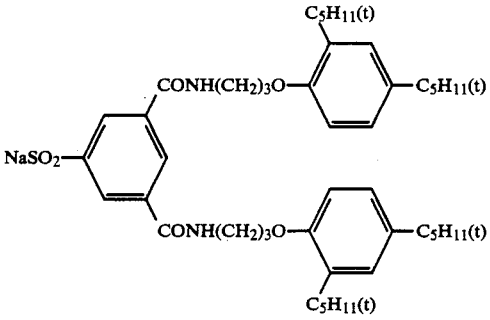

-continued
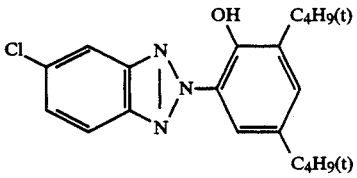
Cpd-7
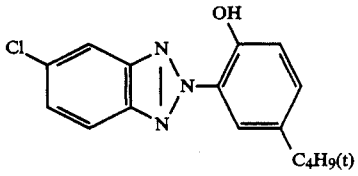
Cpd-8
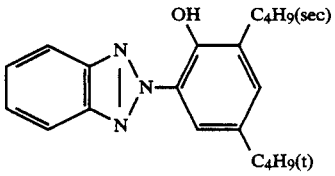
Cpd-9
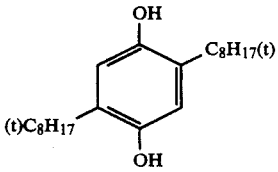
Cpd-10
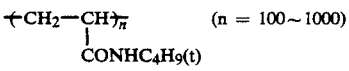
Cpd-11
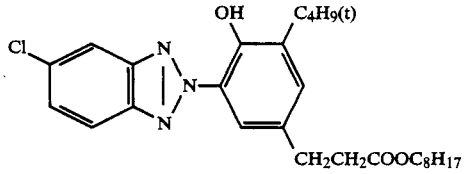
Cpd-12
Dibutyl Phthalate — Solv-1
Tricresyl Phosphate — Solv-2
Trioctyl Phosphate — Solv-3
Trinonyl Phosphate — Solv-4
Cpd-13
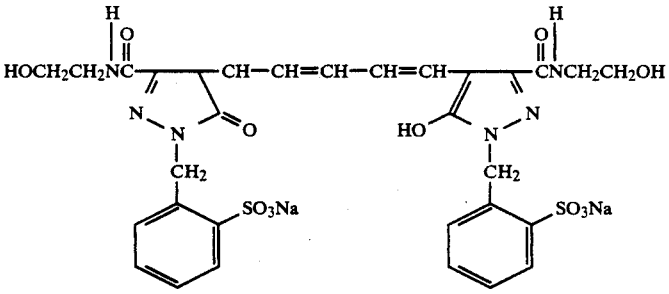

-continued

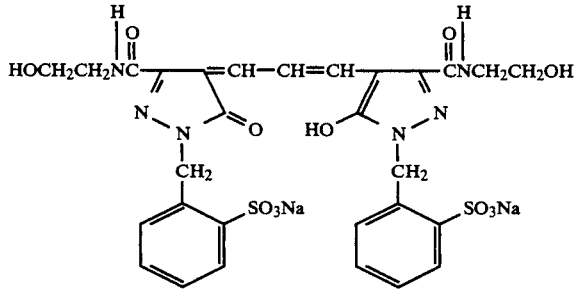

Cpd-14

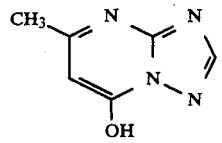

Cpd-15

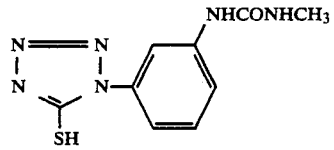

Cpd-16

The color photographic paper thus prepared was exposed to light with 250 CMS and then treated by the following processes using several bleach-fixing solutions which differs in their composition (specified below).

| Process | Temp. (°C.) | Time (sec.) |
|---|---|---|
| Color Development | 38 | 100 |
| Bleach-fixing | 30–34 | 30 |
| Rinse (1) | 30–34 | 20 |
| Rinse (2) | 30–34 | 20 |
| Rinse (3) | 30–34 | 20 |
| Drying | 70–80 | 50 |

(Rinsing was carried out by 3-tank countercurrent system from rinse (3) to rinse (1)).

The composition of each processing solution is as follows:

| (Color Development Solution) | |
|---|---|
| Water | 800 ml |
| Diethylenetriaminepentaacetic acid | 1.0 g |
| 1-Hydroxyethylidene-1,1-diphosphonic acid (60%) | 2.0 g |
| Nitrilotriacetic acid | 2.0 g |
| Triethylenediamine-(1,4-diaza-bicyclo(2,2,2)-octane) | 5.0 g |
| Potassium bromide | 0.5 g |

-continued

| (Color Development Solution) | |
|---|---|
| Potassium carbonate | 30 g |
| N-Ethyl-N-(beta-methanesulfonamidoethyl)-3-methyl-4-aminoaniline sulfate | 5.5 g |
| Diethylhydroxylamine | 4.0 g |
| Fluorescent whitener (available from Ciba Geigy Co., Ltd. under the trade name of UVITEX-CK) | 1.5 g |
| Water | to 1,000 ml |
| pH (at 25° C.) | 10.25 |

(Bleach-fixing Solution)

Presuming the composition of the running equilibrium solution to which the color developer was carried over from the preceding bath, processing solutions (i) to (xi) shown in Table I were prepared.

(Rinsing Solution)

As rinsing solutions, deionized water (the content of calcium and magnesium ions were not more than 3 ppm respectively) was used.

Stains of the light-sensitive materials processed by the foregoing method were determined and the results observed were summarized in Table I. In this respect, the stains were determined by inspecting non-image area with Macbeth reflecting densitometer.

TABLE I

| Bleach-fixing | Comp. Ex. | | Present Invention | | | | | Comp. Ex. |
|---|---|---|---|---|---|---|---|---|
| Solution No. | (i) | (ii) | (iii) | (iv) | (v) | (vi) | (vii) | (viii) |
| $NH_4$ ions Content in Replenisher Bleach-fixing Solution** | 77 | 77 | 88.5 | 88.5 | 88.5 | 94 | 100 | 100 |
| 70% w/v Ammonium Thiosulfate (ml) | 100 | 100 | 100 | 100 | 100 | 100 | 100 | 100 |
| Ferric Ammonium EDTA Dihydrate (g) | 50 | 50 | 50 | 50 | 50 | 50 | 50 | 50 |
| Sodium Sulfite (g) | 20 | 20 | 10 | 10 | 10 | 5 | — | — |
| Ammonium Sulfite | — | — | 9.2 | 9.2 | 9.2 | 13.8 | 18.4 | 18.4 |

TABLE I-continued

| Bleach-fixing Solution No. | Comp. Ex. (i) | (ii) | Present Invention (iii) | (iv) | (v) | (vi) | (vii) | Comp. Ex. (viii) |
|---|---|---|---|---|---|---|---|---|
| (g) | | | | | | | | |
| Color Developer of preceding bath (ml) | 250 | 330 | 100 | 250 | 330 | 250 | 250 | 800 |
| Presumed Ratio: Replenished amount/ amount carried over | 3 | 2 | 9 | 3 | 2 | 3 | 3 | 0.25 |
| Magenta Stains | 0.27 | 0.28 | 0.20 | 0.21 | 0.21 | 0.21 | 0.20 | 0.26 |

**This solution was made up to 1,000 ml with water and pH thereof was adjusted to 7.0 with acetic acid.

EXAMPLE 2

The same procedures as in Example 1 were repeated except that ferric ammonium diethylenetriaminepentaacetate was substituted for ferric ammonium ethylenediaminetetraacetate in the bleach-fixing solutions (iii) to (vii). Likewise, excellent stain inhibiting effect was observed as in Example 1.

EXAMPLE 3

The same procedures as in Example 1 were repeated except that ferric ammonium cyclohexanediaminetetraacetate was substituted for ferric ammonium ethylenediaminetetraacetate in the bleach-fixing solutions (iii) to (vii). Likewise, excellent stain inhibiting effect was observed as in Example 1.

EXAMPLE 4

Light-sensitive materials A to E were prepared by changing the coated amount of silver in each layer of the color photographic paper of Example 1 to values listed in Table II.

TABLE II

| Sample | EM-1 | EM-2 | EM-3 | EM-4 | EM-5 | EM-6 | Total ($g/m^2$) |
|---|---|---|---|---|---|---|---|
| A | 0.30 | 0.30 | 0.10 | 0.20 | 0.10 | 0.30 | 1.30 |
| B | 0.15 | 0.15 | 0.15 | 0.15 | 0.15 | 0.15 | 0.90 |
| C | 0.15 | 0.20 | 0.10 | 0.15 | 0.05 | 0.15 | 0.80 |
| D | 0.15 | 0.15 | 0.05 | 0.15 | 0.05 | 0.15 | 0.70 |
| E | 0.12 | 0.12 | 0.05 | 0.10 | 0.05 | 0.16 | 0.60 |

Each of the photographic paper A to E was treated and thereafter it was examined on the stains in the same manner as in Example 1. In this Example, the bleach-fixing solutions (iii), (vi), (ix) and (x) were used. The results observed are listed in Table III.

TABLE III

| Bleach-fixing Solution | $NH_4^+$ (%) | A | B | C | D | E |
|---|---|---|---|---|---|---|
| (Comparative Example) | | | | | | |
| (iii) | 77 | 0.28 | 0.28 | 0.28 | 0.27 | 0.27 |
| (Present Invention) | | | | | | |
| (vi) | 88.5 | 0.23 | 0.23 | 0.21 | 0.21 | 0.21 |
| (ix) | 94 | 0.23 | 0.23 | 0.21 | 0.21 | 0.21 |
| (x) | 100 | 0.23 | 0.23 | 0.20 | 0.20 | 0.20 |

As seen from the results listed in Table III, the occurrence of stains was certainly suppressed in the present invention, in particular, such an effect was noticeable in Samples C, D and E in which the coated amount of silver was not more than 0.8 $g/m^2$.

EXAMPLE 5

According in the same manner as in Example 1 except for using the following magenta couplers, Samples K to S were prepared.

Sample K

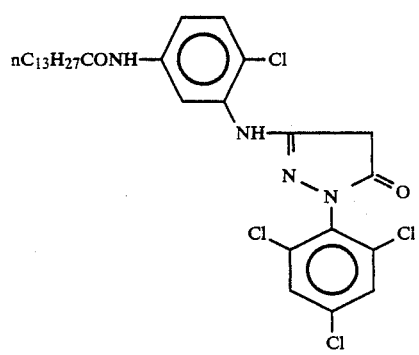

Sample L

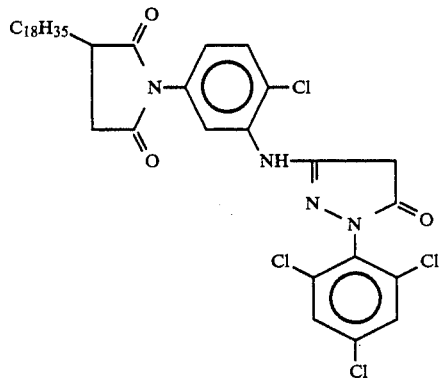

Sample M

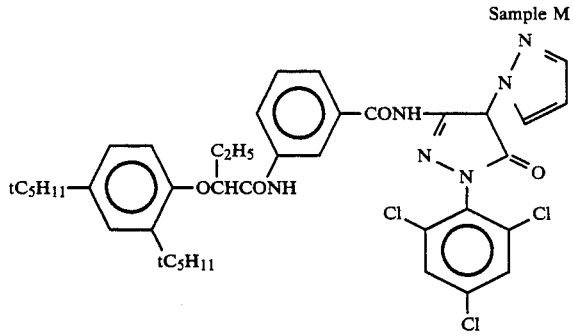

Sample N: M-9
Sample O: M-11
Sample P: M-12
Sample Q: m-2
Sample R: m-4

Sample S: m-10

Samples thus prepared were imagewise exposed to light and running tests were carried out by the following processes until the amount of replenisher for the bleach-fixing solution reached 2 times the volume of the tank therefor. The running tests were carried out utilizing bleach-fixing solutions differing in the amount of ammonium ions as shown in Table IV.

| Process | Temp. (°C.) | Time (sec.) | Amount Replenished (ml) | Tank Volume (l) |
|---|---|---|---|---|
| Color Development | 38 | 100 | 290 | 17 |
| Bleach-fixing | 33 | 30 | 120 | 9 |
| Rinse (1) | 30 to 34 | 20 | — | 4 |
| Rinse (2) | 30 to 34 | 20 | — | 4 |
| Rinse (3) | 30 to 34 | 20 | 364 | 4 |
| Drying | 70 to 80 | 50 | | |

*The amount replenished is expressed in the amount per 1 $m^2$ of the processed light-sensitive material.
**Rinse was carried out by 3-tank countercurrent system from rinse (3) to rinse (1).

The amount carried over from the preceding bath was 40 ml/$m^2$.

The composition of each processing solution is as follows:

| Color Developer | Tank Soln. | Replenisher |
|---|---|---|
| Water | 800 ml | 800 ml |
| Diethylenetriaminepentaacetic acid | 1.0 g | 1.0 g |
| Nitrilotriacetic acid | 2.0 g | 2.0 g |
| 1-Hydroxyethylidene-1,1-diphosphonic acid | 2.0 g | 2.0 g |
| Potassium bromide | 0.5 g | — |
| Potassium carbonate | 30 g | 30 g |
| N-Ethyl-N-(beta-methanesulfonamidoethyl)-3-methyl-4-aminoaniline sulfate | 5.5 g | 7.5 g |
| N,N-Diethylhydroxylamine | 3.6 g | 5.5 g |
| Fluorescent whitener (available from Sumitomo Chemical Company, Limited under the trade name of WHITEX 4B) | 1.5 g | 2.0 g |
| Triethylenediamine-1,4-diazabicyclo(2,2,2)octane | 5.0 g | 5.0 g |
| Water | to 1,000 ml | ad. 1,000 ml |
| pH (at 25° C.) | 10.20 | 10.60 |

Bleach-fixing Solution

Three kinds of solutions shown in Table IV were used. The tank solution was used by diluting the replenisher to ⅔ times the concentration thereof.

The amount of replenisher was 120 ml which corresponded to three times the volume carried over from the preceding bath.

Rinsing Solution: Tank Soln. and Replenisher

Deionized water having the calcium and magnesium contents of not more than 3 ppm respectively was used.

TABLE IV

| Compound | Replenisher for Bleach-fixing process (1) | (2) | (3) |
|---|---|---|---|
| Ammonium (%) | 72 | 86 | 100 |
| Ammonium thiosulfate (ml) | 150 | 150 | 150 |
| Ferric ammonium EDTA (g) | 70 | 70 | 70 |
| Ferric ammonium EDTA (g) | 70 | 70 | 70 |
| Sodium sulfite (g) | 40 | 20 | — |
| Ammonium sulfite (g) | — | 18.4 | 36.8 |

TABLE IV-continued

| Compound | Replenisher for Bleach-fixing process (1) | (2) | (3) |
|---|---|---|---|
| EDTA (g) | 5 | 5 | 5 |

*Each replenisher was made up to 1,000 ml with water and pH thereof was adjusted to 6.0 with acetic acid.

Samples K to S were wedge exposed to light and then processed with each running equilibrium solution obtained above. After processing, the magenta density at non-image areas (Dmin) was determined. Moreover, the magenta density was again determined after storing at 70° C./60% RH for one month. The results observed are listed in Table V.

TABLE V

| Color Photographic Paper | Amount of silver (mg/$cm^2$) | After Processing | Dg After Storage |
|---|---|---|---|
| Comparative Example (bleach-fixing soln. (1)) | | | |
| K | 17 | 0.13 | 0.20 |
| L | 18 | 0.13 | 0.22 |
| M | 18 | 0.14 | 0.24 |
| N | 17 | 0.13 | 0.25 |
| O | 16 | 0.13 | 0.26 |
| P | 17 | 0.13 | 0.25 |
| Q | 18 | 0.13 | 0.23 |
| R | 18 | 0.13 | 0.23 |
| S | 18 | 0.13 | 0.27 |
| Present Invention (bleach-fixing soln. (2)) | | | |
| K | 8 | 0.13 | 0.20 |
| L | 7 | 0.13 | 0.21 |
| M | 7 | 0.14 | 0.23 |
| N | 3 | 0.13 | 0.16 |
| O | 4 | 0.13 | 0.17 |
| P | 4 | 0.13 | 0.16 |
| Q | 4 | 0.13 | 0.16 |
| R | 4 | 0.13 | 0.18 |
| S | 4 | 0.14 | 0.18 |
| Present Invention (bleach-fixing soln. (3)) | | | |
| K | 6 | 0.13 | 0.18 |
| L | 6 | 0.13 | 0.21 |
| M | 5 | 0.14 | 0.22 |
| N | 2 | 0.13 | 0.15 |
| O | 3 | 0.13 | 0.16 |
| P | 3 | 0.13 | 0.16 |
| Q | 2 | 0.13 | 0.15 |
| R | 3 | 0.13 | 0.17 |
| S | 3 | 0.14 | 0.17 |

As seen from Table V, when the bleach-fixing solutions (2) and (3) of the invention were used and the light-sensitive material contained the magenta couplers represented by the general formula (I) or (II), the magenta stains were substantially reduced after processing and after storage (see Samples N to S). Moreover, the amount of residual silver was reduced and the processing solution exhibited excellent desilvering properties.

EXAMPLE 6

The same procedures as in Example 5 were repeated except that light-sensitive materials containing magenta couplers M-1 to M-4, M-6, M-8, m-3, m-4, m-11 and m-12 were used and likewise significant effect in suppressing magenta stains were observed.

EXAMPLE 7

Samples of photographic paper were prepared by applying, in order, 1st layer (lowest layer) to 7th layer (top layer) having the compositions detailed in Table C onto a paper substrate of which both sides had been laminated with polyethylene films and which had been treated by corona discharge. Each coating solution was prepared as follows. The details of structural formulas of couplers, dye image stabilizers and the like will be given below.

The coating solution for 1st layer was prepared as follows. A mixture of 200 g of a yellow coupler, 93.3 g of discoloration inhibitor (r), 10 g of a high boiling solvent (p), 5 g of a solvent (q) and 600 ml of ethyl acetate as an auxiliary solvent was heated at 60° C. to dissolve the compounds and the resulting solution was admixed with 3,300 ml of 5% aqueous gelatin solution containing 330 ml of 5% aqueous solution of Alkanol B (the trade mark of alkylnaphthalene sulfonate; available from Dupont Co., Ltd.). Then, the mixture was emulsified with a colloid mill to form a coupler dispersion. Ethyl acetate in the dispersion was evaporated off under a reduced pressure and the resultant dispersion was added to 1,400 g of an emulsion (corresponding to 96.7 g of elemental silver; containing 170 g of gelatin) to which a sensitizing dye for blue-sensitive emulsion and 1-methyl-2-mercapto-5-acetylamino-1,3,4-triazole had been added to form the intended coating solution. Coating solutions for 2nd to 7th layers having the compositions shown in Table C were prepared in the similar manner.

In each 3rd layer of the photographic paper, the magenta coupler shown in Table VI was used.

TABLE C

| | |
|---|---|
| **7th Layer: Protective Layer** | |
| Gelatin | 600 mg/m$^2$ |
| **6th Layer: Ultraviolet Absorbing Layer** | |
| Ultraviolet absorber (n) | 260 mg/m$^2$ |
| Ultraviolet absorber (o) | 70 mg/m$^2$ |
| Solvent (p) | 300 mg/m$^2$ |
| Solvent (q) | 100 mg/m$^2$ |
| Gelatin | 700 mg/m$^2$ |
| **5th Layer: Red-sensitive Emulsion Layer** | |
| Silver chlorobromide emulsion (AgBr = 1.0 mole %) | 210 mg/m$^2$ |
| Cyan coupler | $5 \times 10^{-4}$ mole/m$^2$ |
| Discoloration inhibitor (r) | 250 mg/m$^2$ |
| Solvent (p) | 160 mg/m$^2$ |
| Solvent (q) | 100 mg/m$^2$ |
| Gelatin | 1800 mg/m$^2$ |
| **4th Layer: Color Mixing Inhibiting Layer** | |
| Color mixing inhibitors (s) | 65 mg/m$^2$ |
| Ultraviolet absorber (n) | 450 mg/m$^2$ |
| Ultraviolet absorber (o) | 230 mg/m$^2$ |
| Solvent (p) | 50 mg/m$^2$ |
| Solvent (q) | 50 mg/m$^2$ |
| Gelatin | 1700 mg/m$^2$ |
| **3rd Layer: Green-sensitive Emulsion Layer** | |
| Silver chlorobromide emulsion (AgBr = 0.5 mole %) | 250 mg/m$^2$ |
| Magenta coupler (see Table VI) | 670 mg/m$^2$ |
| Discoloration inhibitor (t) | 150 mg/m$^2$ |
| Discoloration inhibitor (u) | 10 mg/m$^2$ |
| Solvent (p) | 200 mg/m$^2$ |
| Solvent (q) | 10 mg/m$^2$ |
| Gelatin | 1400 mg/m$^2$ |
| **2nd Layer: Color Mixing Inhibiting Layer** | |

TABLE C-continued

| | |
|---|---|
| **7th Layer: Protective Layer** | |
| Silver chlorobromide emulsion (non-post-ripened; grain size = 0.05 microns) | 10 mg/m$^2$ (Ag) |
| Discoloration inhibitor (s) | 55 mg/m$^2$ |
| Solvent (p) | 30 mg/m$^2$ |
| Solvent (q) | 15 mg/m$^2$ |
| Gelatin | 800 mg/m$^2$ |
| **1st Layer: Blue-sensitive Emulsion Layer** | |
| Silver chlorobromide emulsion (AgBr = 1.0 mole %) | 230 mg/m$^2$ |
| Yellow coupler | 600 mg/m$^2$ |
| Discoloration inhibitor (r) | 280 mg/m$^2$ |
| Solvent (p) | 30 mg/m$^2$ |
| Solvent (q) | 15 mg/m$^2$ |
| Gelatin | 1800 mg/m$^2$ |
| Substrate: Paper substrate both sides of which were laminated with polyethylene films. | |

Compounds used in this Example are as follows:

Ultraviolet Absorber (n):
2-(2-hydroxy-3,5-di-tert-amylphenyl)-benzotriazole

Ultraviolet Absorber (o):
2-(2-hydroxy-3,5-di-tert-butylphenyl)-benzotriazole

Solvent (p):
di-(2-ethylhexyl)-phthalate

Solvent (q):
dibutyl phthalate

Discoloration Inhibitor (r):
2,5-di-tert-amylphenyl-3,5-di-tert-butylhydroxybenzoate Discoloration Inhibitor (s):
2,5-di-tert-octylhydroquinone Discoloration Inhibitor (t):
1,4-di-tert-amyl-2,5-dioctyloxybenzene Discoloration Inhibitor (u):
2,2'-methylene-bis(4-methyl-6-tert-butylphenol)

In each emulsion layer, the following sensitizing dye was used.

Blue-sensitive Emulsion Layer: anhydro-5-methoxy-5'-methyl-3,3'-disulfopropylselenacyanine hydroxide;

Green-sensitive Emulsion Layer: anhydro-9-ethyl-5,5'-diphenyl-3,3'-disulfoethyloxacarbocyanine hydroxide;

Red-sensitive Emulsion Layer: 3,3'-diethyl-5-methoxy-9,9'-(2,2-dimethyl-1,3-propano)-thiadicarbocyanine iodide.

1-Methyl-2-mercapto-5-acetylamino-1,3,4-triazole was used as a stabilizer for each emulsion layer:

The following compounds were used as irradiation inhibiting dyes:

Dipotassium 4-(3-carboxy-5-hydroxy-4-(3-(3-carboxy-5-oxo-1-(4-sulfonatophenyl)-2-pyrazolin-4-ylidene)-1-propenyl)-1-pyrazolyl)-benzenesulphonate; and Tetrasodium N,N'-(4,8-dihydroxy-9,10-dioxo-3,7-disulfonato-anthracene-1,5-diyl)-bis(aminomethanesulfonate).

As a hardening agent, 1,2-bis(vinylsulfonyl)-ethane was used.

The following couplers were used.

Yellow Coupler:

-continued

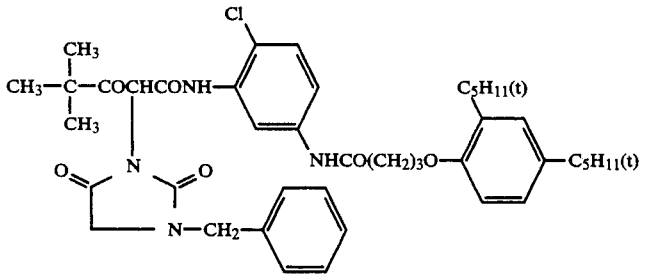

Magenta Coupler: See Table VI

Cyan Coupler:

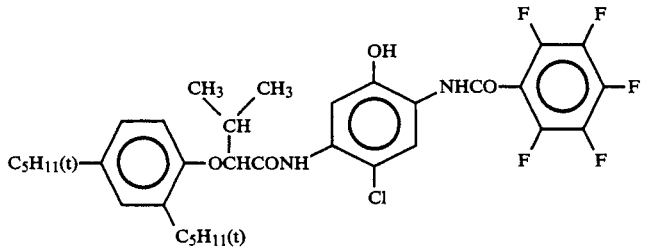

and

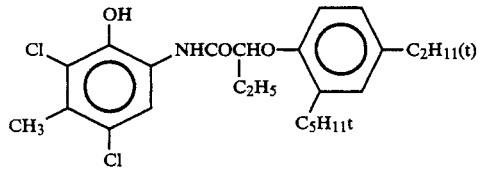

(molar ratio = 1:1)

The multilayered color photographic paper thus prepared were wedge exposed to light and then treated by the following processes:

| Process | Temp. (°C.) | Time (sec.) |
|---|---|---|
| Color Development | 35 | 45 |
| Bleach-fixing | 35 | 30 |
| Rinse (1) | 35 | 30 |
| Rinse (2) | 35 | 30 |
| Rinse (3) | 35 | 30 |
| Drying | 60–70 | 50 |

*Rinse was carried out by 3-tank countercurrent system from rinse (3) to rinse (1).

The composition of the tank solution used is as follows:

| Color Developer | Tank Soln. |
|---|---|
| Triethanolamine | 10 ml |
| N,N-Diethylhydroxylamine | 4.0 g |
| Fluorescent whitener (4,4'-diamino-stilbene type) | 3.0 g |
| Ethylenediamine-N,N,N'-N'-tetramethylene-phosphonic acid | 1.0 g |
| Potassium carbonate | 30.0 g |
| Sodium chloride | 1.4 g |
| 4-Amino-3-methyl-N-ethyl-N-(beta-(methane-sulfonamido)-ethyl)-aniline sulfate | 5.0 g |
| Sodium sulfite | 0.1 g |
| 1,2-Dihydroxybenzo-3,4,6-trisulfonic acid | 300 mg |
| Water | to 1,000 ml |
| pH | 10.10 |

Bleach-fixing Solution

The following solutions (1) to (7) were used.

| Solution No. | (1) | (2) | (3) | (4) | (5) | (6) | (7) |
|---|---|---|---|---|---|---|---|
| Ammonium ions (%) | 77 | 77 | 66 | 88.5 | 88.5 | 96 | 100 |
| Amount Replenished/ Amount Carried over (estimation) | 9 | 9 | 9 | 9 | 9 | 9 | 9 |
| 70% Ammonium Thiosulfate (ml) | 100 | 100 | 50 | 100 | 100 | 100 | 100 |
| Na Thiosulfate (g) | — | — | 37.3 | — | — | — | — |
| EDTA Fe (III) Ammonium (g) | 40 | 40 | 40 | 40 | 40 | 40 | 40 |
| Sodium Sulfite (g) | 20 | — | — | 10.0 | 10.0 | — | — |
| Potassium Sulfite (g) | — | 25 | — | — | 12.5 | 6.3 | — |
| Ammonium Sulfite (g) | — | — | 18.4 | 9.2 | 9.2 | 13.8 | 18.4 |
| EDTA (g) | 5 | 5 | 5 | 5 | 5 | 5 | 5 |
| Color Developer (ml) | 100 | 100 | 100 | 100 | 100 | 100 | 100 |

| Rinsing Solution: Tank Soln. and Replenisher | |
|---|---|
| 5-Chloro-2-methyl-4-isothiazolin-3-one | 40 mg |
| 2-Methyl-4-isothiazolin-3-one | 10 mg |
| 2-Octyl-4-isothiazolin-3-one | 10 mg |
| 40% Solution of bismuth chloride | 0.5 g |
| 40% Solution of nitrilo-N,N,N-trimethylene-phosphonic acid | 1.0 g |
| 60% Solution of 1-hydroxyethylidene-1,1-diphosphonic acid | 2.5 g |
| Fluorescent whitener (4,4'-diaminostilbene type) | 1.0 g |
| 26% aqueous ammonia | 2.0 ml |

-continued

| | |
|---|---|
| Water | to 1,000 ml |
| pH (adjusted with KOH) | 7.5 |

*Each solution was made up to 1,000 ml with water and pH thereof was adjusted with acetic acid.

The amount of residual silver at Dmax (corresponding to portions having highest density) of the processed color photographic paper was determined by fluorescent X-ray method. In addition, difference (Dg) between the magenta densities of the non-image portions before and after storing at 40° C./70% RH for 2 months was determined. The results observed are summarized in Table VI.

TABLE VI

| | | (Comparative Example) Bleach-fixing Solution | | | | | |
|---|---|---|---|---|---|---|---|
| | | (1) | | (2) | | (3) | |
| | | Ammonium ions (%) | | | | | |
| | | 77 | | 77 | | 66 | |
| Sample No. | Magenta Coupler | Amount of Ag (mg/cm²) | Dg | Amount of Ag (mg/cm²) | Dg | Amount of Ag (mg/cm²) | Dg |
| T | Same as Sample K | 15 | +0.05 | 16 | +0.07 | 18 | +0.07 |
| U | Same as Sample L | 14 | +0.06 | 15 | +0.07 | 17 | +0.07 |
| V | M-9 | 15 | +0.12 | 14 | +0.12 | 17 | +0.14 |
| W | M-11 | 15 | +0.13 | 15 | +0.12 | 18 | +0.16 |
| X | M-12 | 15 | +0.14 | 15 | +0.13 | 18 | +0.17 |
| Y | M-2 | 16 | +0.12 | 15 | +0.13 | 17 | +0.16 |

| | (Present Invention) Bleach-fixing Solution | | | | | | | |
|---|---|---|---|---|---|---|---|---|
| | (4) | | (5) | | (6) | | (7) | |
| | Ammonium ions (%) | | | | | | | |
| | 88.5 | | 88.5 | | 96 | | 100 | |
| Sample No. | Amount of Ag (mg/cm²) | Dg | Amount of Ag (mg/cm²) | Dg | Amount of Ag (mg/cm²) | Dg | Amount of Ag (mg/cm²) | Dg |
| T | 7 | +0.07 | 7 | +0.05 | 5 | +0.05 | 4 | +0.05 |
| U | 6 | +0.06 | 7 | +0.06 | 6 | +0.06 | 5 | +0.06 |
| V | 4 | +0.04 | 4 | +0.04 | 3 | +0.02 | 2 | +0.02 |
| W | 4 | +0.04 | 3 | +0.04 | 2 | +0.02 | 1 | +0.02 |
| X | 4 | +0.03 | 4 | +0.03 | 3 | +0.02 | 1 | +0.02 |
| Y | 4 | +0.04 | 4 | +0.03 | 3 | +0.02 | 1 | +0.02 |

As seen from the results listed in Table VI, the method of the present invention exhibits excellent desilvering properties. Moreover, if compounds (I) or (II) are used as the magenta couplers, the occurrence of magenta stains after processing can be substantially suppressed.

What is claimed is:

1. A method for processing a silver halide color photographic light-sensitive material having a coated silver halide in an amount of not more than 0.8 g/m² as an amount of elemental silver, which comprises color developing the light-sensitive material and then subjecting the developed material to a bleach-fixing treatment of a single bleach-fixing bath containing a bleach-fixing solution, the amount of bleach-fixing solution replenished being 0.2 to 15 times the volume of the color developer carried over, to the bleach-fixing bath by the processed light-sensitive material per unit area thereof, and the amount of the replenisher for the bleach-fixing bath also being 20 to 250 ml per 1 m² of the processed light-sensitive material, and further wherein not less than 80 mole % of the total non-metallic cations present in the replenisher for the bleach-fixing solution comprise ammonium ions.

2. A method as set forth in claim 1 wherein the silver halide color photographic light-sensitive material comprises at least one magenta coupler represented by the following general formula (I) or (II):

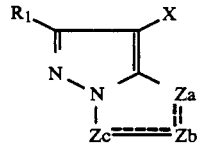

(I)

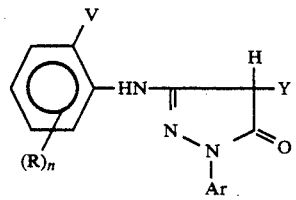

(II)

in the general formula (I), $R_1$ represents a hydrogen atom or a substituent; X represents a hydrogen atom or a group which may be eliminated through a coupling reaction with an oxidized form of an aromatic primary amine developing agent; Za, Zb and Zc represent a methine, a substituted methine, =N— or —NH—, provided that one of the bonds Za-Zb and Zb-Zc is a double bond while the other is a single bond, that if Zb-Zc bond is a carbon-carbon bond, these may be a part of an aromatic ring, that these may form a dimer or a higher polymer at $R_1$ or X and that if Za, Zb or Zc is a substituted methine, these may form a dimer or a higher polymer at the substituted methine; and in the general formula (II), Ar is a phenyl group which may be substituted; Y represents a group which is eliminated when the coupler causes coupling reaction with an oxidized form of an aromatic primary amine developing agent to form a dye; V is a halogen atom, an alkoxy group or an alkyl group; R represents a group which may be substituted on a benzene ring provided that if n is 2, R may be the same or different; and n is an integer of 1 or 2.

3. A method as set forth in claim 2 wherein the magenta coupler represented by the general formula (I) is selected from the group consisting of those represented by the following general formulas (Ia), (Ib), (Ic), (Id), (Ie) and (If):

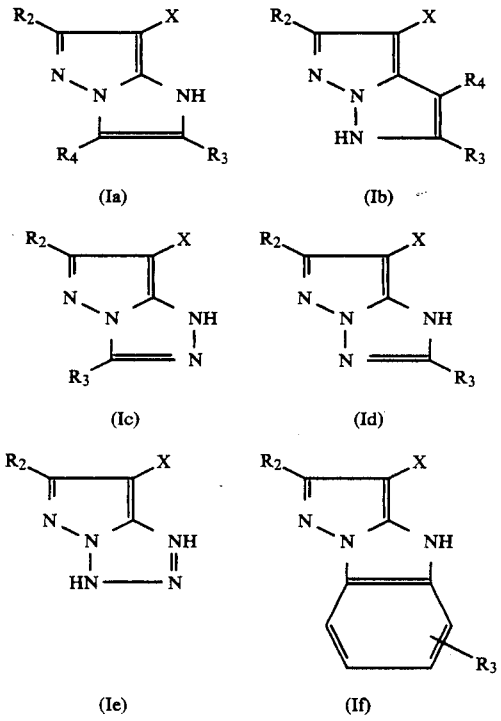

in the general formulas (Ia) to (If), the substituents $R_2$ to $R_4$ may be the same or different and independently represent a hydrogen atom, a halogen atom, an alkyl group, an aryl group, a heterocyclic group, a cyano group, an alkoxy group, an aryloxy group, a heterocycloxy group, an acyloxy group, a carbamoyloxy group, a silyloxy group, a sulfonyloxy group, an acylamino group, an anilino group, an ureido group, an imido group, a sulfamoylamino group, a carbamoylamino group, an alkylthio group, an arylthio group, a heterocyclthio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, or an aryloxycarbonyl group; X represents a hydrogen atom, a halogen atom, a carboxyl group, or a group which is bonded to the carbon atom at the coupling position through an oxygen, nitrogen or sulfur atom and can be eliminated through the coupling reaction; provided that $R_2$, $R_3$, $R_4$ or X may be a bivalent group to form bisproducts; and that if the parts represented by the formulas (Ia) to (If) are moieties of vinyl monomers, one of $R_2$ to $R_4$ represents a single bond or a connecting group through which the vinyl group and moieties (Ia) to (If) are bonded together.

4. A method as set forth in claim 2 wherein the magenta coupler represented by the formula (II) is selected from the group consisting of couplers having the formula (II) in which Ar represents a phenyl group or a phenyl group substituted with halogen atoms, alkyl groups having 1 to 5 carbon atoms, alkoxy groups having 1 to 5 carbon atoms, aryloxy groups, alkoxycarbonyl groups, cyano group, carbamoyl group, sulfamoyl group, sulfonyl group, sulfonamido group and acylamino group, the phenyl group may have 2 or more of these substituents; Y represents a halogen atom, an alkoxy group, an aryloxy group, an acyloxy group, an arylthio group, an alkylthio group, or a group represented by the formula:

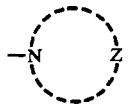

(wherein Z denotes an atomic group required to form 5- or 6-membered ring together with the nitrogen atom and an atom selected from the group consisting of carbon, oxygen, nitrogen and sulfur atoms); V represents a halogen atom, or an alkoxy group or an alkyl group having 1 to 5 carbon atoms; R represents a group which may be substituted on the benzene ring and n is an integer of 1 or 2 provided that if n is 2, two substitutents R may be the same or different.

5. A method as set forth in claim 1 wherein 90 to 100 mole% of the total non-metallic cations in the replenisher for the bleach-fixing bath is ammonium ions.

6. A method as set forth in claim 1 wherein all the components of the bleach-fixing solution are used in the form of ammonium salts.

7. A method as set forth in claim 1 wherein the amount of the replenisher for the bleach-fixing bath is 1.0 to 14 times the volume of color developer carried over by the processed light-sensitive material per unit area thereof.

8. A method as set forth in claim 1 wherein the amount of the bleaching agent is 0.01 to 1.0 mole/l and that of the fixing agent is 0.3 to 2 mole/l.

9. A method as set forth in claim 1 wherein the bleach-fixing solution comprises at least one sulfite ion releasing agent in an amount of 0.02 to 0.5 mole/l.

10. A method as set forth in claim 1 wherein the time required for bleach-fixing process is not more than 4 minutes.

11. A method as set forth in claim 10 wherein the time required for the bleach-fixing process is 15 to 120 seconds.

12. A method as set forth in claim 1 wherein the amount of replenisher for the color developing process is 20 to 600 ml per 1 $m^2$ of the processed light-sensitive material.

13. A method as set forth in claim 1 wherein, after the bleach-fixing treatment, water washing and/or stabilization processes are carried out by multistage countercurrent system.

14. A method as set forth in claim 13 wherein the amount of washing water and/or the stabilization solution replenished is 0.5 to 50 times the volume of the preceding bath solution carried over by the processed light-sensitive material per unit area thereof.

15. A method as set forth in claim 1 wherein the bleach-fixing solution contains bleaching agent, fixing agent and preservative in the form of ammonium salt.

* * * * *

UNITED STATES PATENT AND TRADEMARK OFFICE

CERTIFICATE OF CORRECTION

PATENT NO. : 4,954,426

DATED : September 4, 1990

INVENTOR(S) : Takatoshi ISHIKAWA

It is certified that error appears in the above-identified patent and that said Letters Patent is hereby corrected as shown below:

ON TITLE PAGE:

[54] METHOD FOR PROCESSING SILVER HALIDE COLOR PHOTOGRAPHIC LIGHT-SENSITIVE MATERIALS

Signed and Sealed this

Fourteenth Day of January, 1992

*Attest:*

HARRY F. MANBECK, JR.

*Attesting Officer*

*Commissioner of Patents and Trademarks*